US011149451B2

(12) United States Patent
Shima et al.

(10) Patent No.: US 11,149,451 B2
(45) Date of Patent: Oct. 19, 2021

(54) TYING MACHINE

(71) Applicant: MAKITA CORPORATION, Anjo (JP)

(72) Inventors: Kunihisa Shima, Anjo (JP); Yuki Kawai, Anjo (JP)

(73) Assignee: MAKITA CORPORATION, Anjo (JP)

( * ) Notice: Subject to any disclaimer, the term of this patent is extended or adjusted under 35 U.S.C. 154(b) by 366 days.

(21) Appl. No.: 16/222,632

(22) Filed: Dec. 17, 2018

(65) Prior Publication Data

US 2019/0194959 A1 Jun. 27, 2019

(30) Foreign Application Priority Data

Dec. 27, 2017 (JP) ..... JP2017-252085

(51) Int. Cl.
*B21F 15/04* (2006.01)
*E04G 21/12* (2006.01)

(52) U.S. Cl.
CPC ..... *E04G 21/123* (2013.01)

(58) Field of Classification Search
CPC ... E04G 21/122; E04G 21/123; B65B 13/025; B65B 13/04; B65B 13/18; B65B 13/185; B25B 25/00; B21F 15/02; B21F 15/04
See application file for complete search history.

(56) References Cited

U.S. PATENT DOCUMENTS

| | | | | |
|---|---|---|---|---|
| 6,401,766 | B1 * | 6/2002 | Ishikawa | B65B 13/285 140/119 |
| 9,192,979 | B2 * | 11/2015 | Itagaki | B65B 13/22 |
| 2006/0283516 | A1 | 12/2006 | Nagaoka et al. | |
| 2007/0199610 | A1 | 8/2007 | Itagaki | |
| 2009/0283172 | A1 | 11/2009 | Itagaki | |
| 2010/0313991 | A1 | 12/2010 | Nagaoka et al. | |

FOREIGN PATENT DOCUMENTS

| | | | |
|---|---|---|---|
| CN | 1768188 | A | 5/2006 |
| CN | 102556393 | A | 7/2012 |
| JP | H11-156749 | A | 6/1999 |
| JP | 2006-027685 | A | 2/2006 |

OTHER PUBLICATIONS

Mar. 26, 2021 Office Action issued in Chinese Patent Application No. 201811608488.0.

* cited by examiner

*Primary Examiner* — Debra M Sullivan
(74) *Attorney, Agent, or Firm* — Oliff PLC

(57) ABSTRACT

A tying machine may include a feeding mechanism configured to feed a tying string, a battery, and a voltage detection circuit configured to detect a voltage of the battery. The feeding mechanism may include a feeding motor to which power is supplied from the battery. The tying machine may be configured to set a duty ratio for driving the feeding motor when feeding the tying string, in accordance with the voltage of the battery detected by the voltage detection circuit.

4 Claims, 29 Drawing Sheets

TYING MACHINE

CROSS-REFERENCE

This application claims priority to Japanese patent application No. 2017-252085, filed on Dec. 27, 2017, the entire contents of which are incorporated herein by reference.

TECHNICAL FIELD

The technique disclosed herein relates to a tying machine.

BACKGROUND

Japanese Patent Application Publication No. 2006-27685 describes a tying machine provided with a feeding mechanism configured to feed a tying string. The feeding mechanism is provided with a feeding motor.

SUMMARY

In a tying machine as above, a feeding motor rotates for a while due to inertia before the feeding motor actually stops since the feeding motor was instructed to stop, by which a tying string is fed out by an extra amount for a while. Due to this, a total amount of the tying string fed out is a total of an amount thereof fed out before the feeding motor was instructed to stop and the amount fed out after the feeding motor was instructed to stop (overshoot amount).

Such an overshoot amount of the tying string changes according to a rotation speed of the feeding motor at a time point when the feeding motor was instructed to stop. The overshoot amount of the tying string becomes large when the rotation speed of the feeding motor at the time point when the feeding motor was instructed to stop is fast, since the feeding motor stops after having rotated for a while by inertia. Contrary to this, the overshoot amount of the tying string becomes small when the rotation speed of the feeding motor at the time point when the feeding motor was instructed to stop is slow, since the feeding motor stops without having rotated much by inertia.

In a tying machine as above, the overshoot amount of the tying string varies when there is a variation in the rotation speed of the feeding motor at the time point when the feeding motor was instructed to stop, as a result of which the amount of the tying string that is fed out in total varies as well. The disclosure herein provides a technique that enables to suppress a variation in an amount of a tying string fed out from a feeding mechanism in a tying machine provided with the feeding mechanism.

A tying machine disclosed herein may comprise a feeding mechanism configured to feed a tying string, a battery, and a voltage detection circuit configured to detect a voltage of the battery. The feeding mechanism may include a feeding motor to which power is supplied from the battery. The tying machine may be configured to set a duty ratio for driving the feeding motor when feeding the tying string, in accordance with the voltage of the battery detected by the voltage detection circuit.

In the configuration in which the feeding motor has the power supplied from the battery, a rotation speed of the feeding motor changes according to the voltage of the battery. When there is a variation in the rotation speed of the feeding motor at a time point when the feeding motor is instructed to stop, an overshoot amount of the tying string caused before the feeding motor is actually stopped varies, and a total amount of the fed-out tying string also varies.

According to the above tying machine, since the duty ratio for driving the feeding motor is set according to the voltage of the battery, the variation in the rotation speed of the feeding motor caused by the variation in the voltage of the battery can be suppressed. With such a configuration, the amount of the tying string fed out from the feeding mechanism can be suppressed from varying.

Another tying machine disclosed herein may comprise a feeding mechanism configured to feed a tying string, and a battery. The feeding mechanism may include a feeding motor to which power is supplied from the battery, and a rotation speed sensor configured to detect a rotation speed of the feeding motor. The tying machine may be configured to adjust a duty ratio for driving the feeding motor in accordance with the rotation speed of the feeding motor detected by the rotation speed sensor so as to maintain the rotation speed of the feeding motor constant while feeding the tying string.

According to the above configuration, the rotation speed of the feeding motor is maintained constant while the tying string is being fed out, so the variation in the rotation speed of the feeding motor caused by the variation in the voltage of the battery can be suppressed. The amount of the tying string fed out from the feeding mechanism can be prevented from varying.

DETAILED DESCRIPTION

Figure 1:
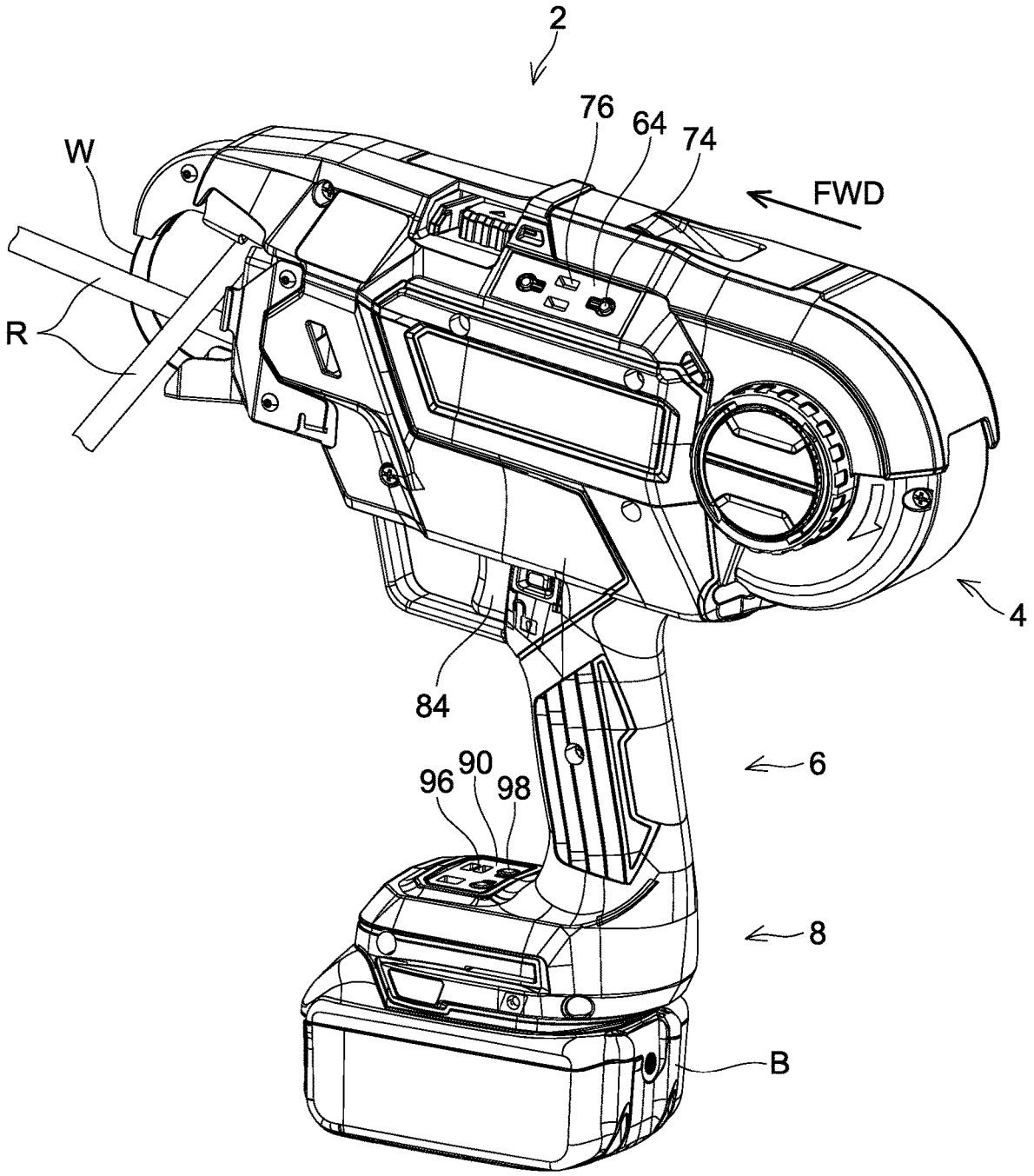
FIG. 1 is a perspective view seeing a rebar tying machine 2 according to an embodiment from an upper left rear side.

Representative, non-limiting examples of the present invention will now be described in further detail with reference to the attached drawings. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide improved tying machines, as well as methods for using and manufacturing the same.

Moreover, combinations of features and steps disclosed in the following detailed description may not be necessary to practice the invention in the broadest sense, and are instead taught merely to particularly describe representative examples of the invention. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more embodiments, a tying machine may comprise a twisting mechanism configured to twist a tying string. The twisting mechanism may include a twisting motor. The tying machine may be configured to obtain torque acting on the twisting motor as a twisting torque value, and stop the twisting motor when a predetermined tying completion condition is satisfied. The tying completion condition may include that an elapsed time since a rise in the twisting torque value was detected reaches a first predetermined time.

In the above tying machine, the twisting motor is stopped based on the elapsed time from the rise in the twisting torque value. Due to this, even if the twisting torque value increases and decreases due to the tying string being displaced on a surface of an object to be tied while the twisting mechanism is twisting the tying string, an error determination that twisting of the tying string is completed will not be made.

In one or more embodiments, a tying machine may comprise a twisting mechanism configured to twist a tying string. The twisting mechanism may include a twisting motor. The tying machine may be configured to obtain torque acting on the twisting motor as a twisting torque value, and stop the twisting motor when a predetermined tying completion condition is satisfied. The tying completion condition may include that a number of times the twisting motor rotated since a rise in the twisting torque value was detected reaches a first predetermined number of times of rotations.

In the above tying machine, the twisting motor is stopped based on the number of times the twisting motor rotated since the rise in the twisting torque value. Due to this, even if the twisting torque value increases and decreases due to the tying string being displaced on the surface of the object to be tied while the twisting mechanism is twisting the tying string, the error determination that twisting of the tying string is completed will not be made.

In one or more embodiments, the tying completion condition may further include that the twisting torque value reaches a predetermined torque threshold.

According to the above tying machine, the tying machine can be suppressed from receiving an excessive reaction force as a reaction to excessive twisting.

In one or more embodiments, the tying machine may be configured not to stop the twisting motor even when the tying completion condition is satisfied, in a case where a number of times the twisting motor rotated since the twisting motor started rotating has not reached a predetermined rotation number threshold. The tying machine may be configured to stop the twisting motor in a case where the tying completion condition is satisfied and the number of times the twisting motor rotated since the twisting motor started rotating reaches the predetermined rotation number threshold.

According to the above tying machine, the number of times of twisting that is required at minimum for tying the object to be tied can be applied to the tying string.

In one or more embodiments, when a predetermined cancellation condition is satisfied after the rise in the twisting torque value has been detected, the tying machine may be configured to cancel detection of the rise in the twisting torque value.

For example, in a case where the tying string is displaced greatly on the surface of the object to be tied while the twisting mechanism is twisting the tying string, it is preferable to redo the process to sufficiently twist the tying string again. According to the above tying machine, the detection of the rise in the twisting torque value can be cancelled to redo the process, and the tying string can sufficiently be twisted again.

In one or more embodiments, the detection of the rise in the twisting torque value may include detection of change from a state in which the twisting torque value is equal to a rate limiter value calculated based on the twisting torque value to a state in which the twisting torque value is higher than the rate limiter value.

The twisting torque value increases moderately until the tying string is brought into tight contact around the object to be tied, and increases rapidly once the tying string is in tight contact around the object to be tied. To detect the rise in the twisting torque value that changes as above, the above tying machine uses the rate limiter value. The rate limiter value moderately follows the twisting torque value in a range between a maximum increase value and a maximum decrease value. Due to this, the rate limiter value can follow the twisting torque value when the change in the twisting torque value is moderate, by which they become equal to each other. To the contrary, when the change in the twisting torque value is rapid, the rate limiter value cannot follow the twisting torque value, by which a difference between them increases. According to the above tying machine, the rise in the twisting torque value can be detected accurately by using the rate limiter value.

In one or more embodiments, the cancellation condition may include that the rate limiter value becomes equal to the twisting torque value again.

In a case where, after the rise in the twisting torque value has been detected due to a state switch from a state in which the rate limiter value is equal to the twisting torque value to a state in which the twisting torque value is higher than the rate limiter value, the twisting torque value continues to increase while the rate limiter value does not become equal to the twisting torque value again, this can be considered as that the tying string is not greatly displaced on the surface of the object to be tied, and the tying of the object to be tied is in progress under good condition. Contrary to this, in a case where the rate limiter value becomes equal to the twisting torque value again after the rise in the twisting torque value has been detected due to the state switch from the state in which the rate limiter value is equal to the twisting torque value to the state in which the twisting torque value is higher than the rate limiter value, that is, in a case where the twisting torque value decreases by a relatively large drop, the tying string is greatly displaced on the surface of the object to be tied, and it is necessary to redo the process to sufficiently twist the tying string again. According to the above tying machine, even in the case where the tying string is greatly displaced on the surface of the object to be tied while the twisting mechanism is twisting the tying string, the tying string can sufficiently be twisted again.

In one or more embodiments, in a case where the rise in the twisting torque value is not detected and a fall in the twisting torque value is detected, the tying machine may be configured to stop the twisting motor when an elapsed time since the fall in the twisting torque value was detected reaches a second predetermined time.

According to the above tying machine, the twisting motor can promptly be stopped in a case where the tying string breaks before stopping the twisting motor.

In one or more embodiments, in a case where the rise in the twisting torque value is not detected and a fall in the twisting torque value is detected, the tying machine may be configured to stop the twisting motor when a number of times the twisting motor rotated since the fall in the twisting torque value was detected reaches a second predetermined number of times of rotations.

According to the above tying machine, the twisting motor can promptly be stopped in the case where the tying string breaks before stopping the twisting motor.

In one or more embodiments, the detection of the fall in the twisting torque value may include detection of change from a state in which the twisting torque value is equal to a rate limiter value calculated based on the twisting torque value to a state in which the twisting torque value is lower than the rate limiter value.

The twisting torque value rapidly increases once the tying string is in tight contact around the object to be tied, however, it rapidly decreases when the tying string breaks. To detect the fall in the twisting torque value that changes as above, the above tying machine uses the rate limiter value. The rate limiter value moderately follows the twisting torque value in a range between a maximum increase value and a maximum decrease value. Due to this, the rate limiter value can follow the twisting torque value when the change in the twisting torque value is moderate, by which they become equal to each other. To the contrary, when the change in the twisting torque value is rapid, the rate limiter value cannot follow the twisting torque value, by which the difference between them increases. According to the above tying machine, the fall in the twisting torque value can accurately be detected by using the rate limiter value.

In one or more embodiments, a tying machine may comprise a feeding mechanism configured to feed a tying string, a battery, and a voltage detection circuit configured to detect a voltage of the battery. The feeding mechanism may include a feeding motor to which power is supplied from the battery. The tying machine may be configured to set a duty ratio for driving the feeding motor when feeding the tying string, in accordance with the voltage of the battery detected by the voltage detection circuit.

In the configuration in which the feeding motor has the power supplied from the battery, a rotation speed of the feeding motor changes according to the voltage of the battery. When there is a variation in the rotation speed of the feeding motor at a time point when the feeding motor is instructed to stop, an overshoot amount of the tying string caused until the feeding motor is actually stopped varies, and a total amount of the fed-out tying string also varies. According to the above tying machine, since the duty ratio for driving the feeding motor is set according to the voltage of the battery, the variation in the rotation speed of the feeding motor caused by the variation in the voltage of the battery can be suppressed. With this configuration, the amount of the tying string fed out from the feeding mechanism can be suppressed from varying.

In one or more embodiments, the tying machine may be configured to set the duty ratio for driving the feeding motor in accordance with the voltage of the battery detected by the voltage detection circuit before feeding the tying string, and maintain the duty ratio for driving the feeding motor constant while feeding the tying string.

According to the above configuration, the duty ratio set in accordance with the actual voltage of the battery is maintained constant while the tying string is fed out, so the variation in the rotation speed of the feeding motor caused by the variation in the voltage of the battery can be suppressed. The amount of the tying string fed out from the feeding mechanism can be prevented from varying.

In one or more embodiments, the tying machine may be configured to adjust the duty ratio for driving the feeding motor in accordance with the voltage of the battery detected by the voltage detection circuit so as to maintain an average applied voltage on the feeding motor constant while feeding the tying string.

According to the above configuration, the average applied voltage on the feeding motor is maintained constant while the tying string is fed out, so the variation in the rotation speed of the feeding motor caused by the variation in the voltage of the battery can be suppressed. The amount of the tying string fed out from the feeding mechanism can be prevented from varying.

In one or more embodiments, a tying machine may comprise a feeding mechanism configured to feed a tying string, and a battery. The feeding mechanism may include a feeding motor to which power is supplied from the battery, and a rotation speed sensor configured to detect a rotation speed of the feeding motor. The tying machine may be configured to adjust a duty ratio for driving the feeding motor in accordance with the rotation speed of the feeding motor detected by the rotation speed sensor so as to maintain the rotation speed of the feeding motor constant while feeding the tying string.

According to the above configuration, the rotation speed of the feeding motor is maintained constant while the tying string is fed out, so the variation in the rotation speed of the feeding motor caused by the variation in the voltage of the battery can be suppressed. The amount of the tying string fed out from the feeding mechanism can be prevented from varying.

Embodiment

A rebar tying machine 2 according to an embodiment will be described with reference to the drawings. The rebar tying machine 2 shown in FIG. 1 is a power tool for tying a plurality of rebars R being an object to be tied by using a wire W being a tying string.

The rebar tying machine 2 includes a tying machine body 4, a grip 6 provided at a lower part of the tying machine body 4, and a battery receiving unit 8 provided at a lower part of the grip 6. A battery B is detachably attached to a lower part of the battery receiving unit 8. The tying machine body 4, the grip 6, and the battery receiving unit 8 are configured integrally.

Figure 2:
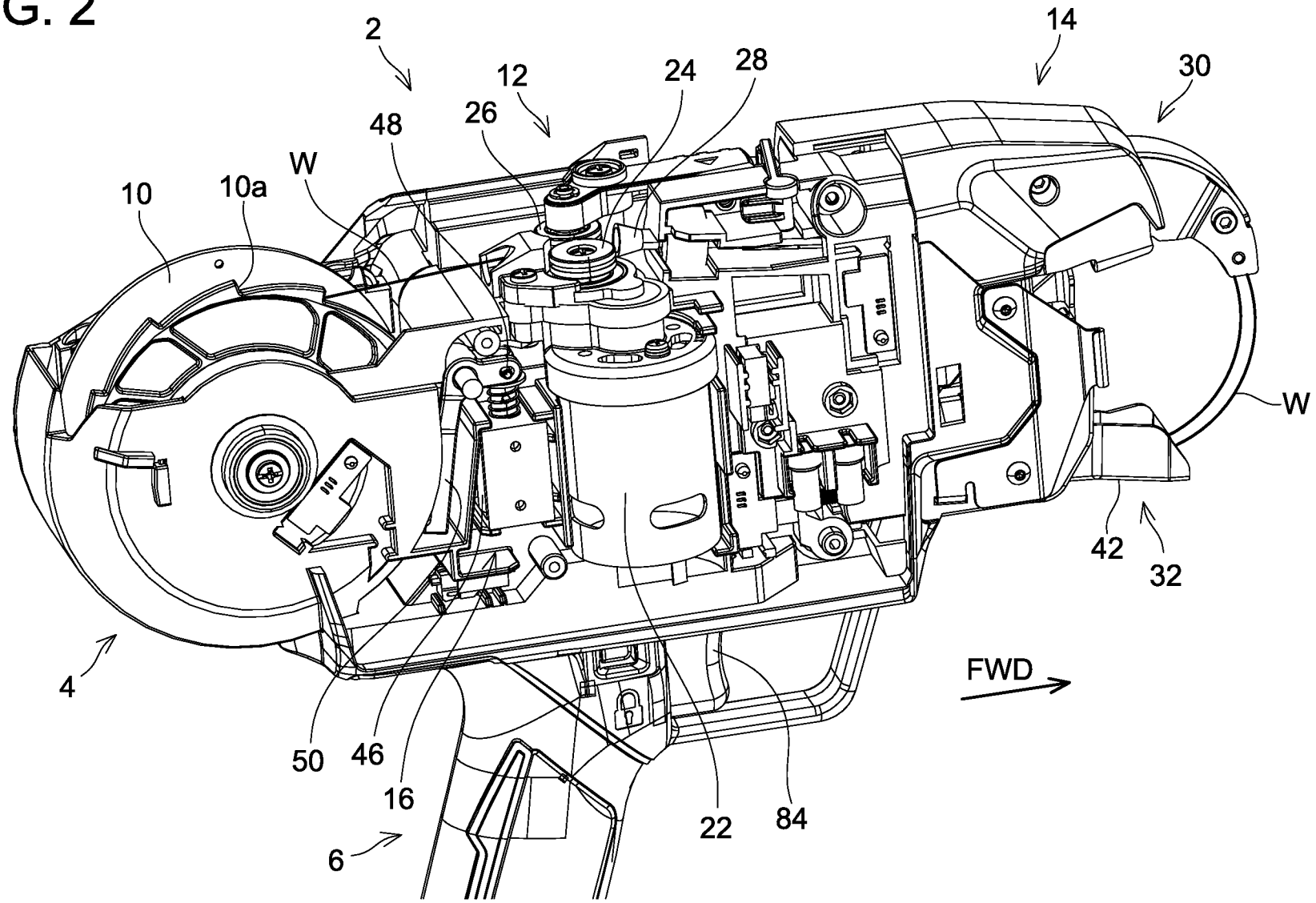
FIG. 2 is a perspective view seeing an internal structure of a tying machine body 4 of the rebar tying machine 2 according to the embodiment from an upper right rear side.
Figure 3:
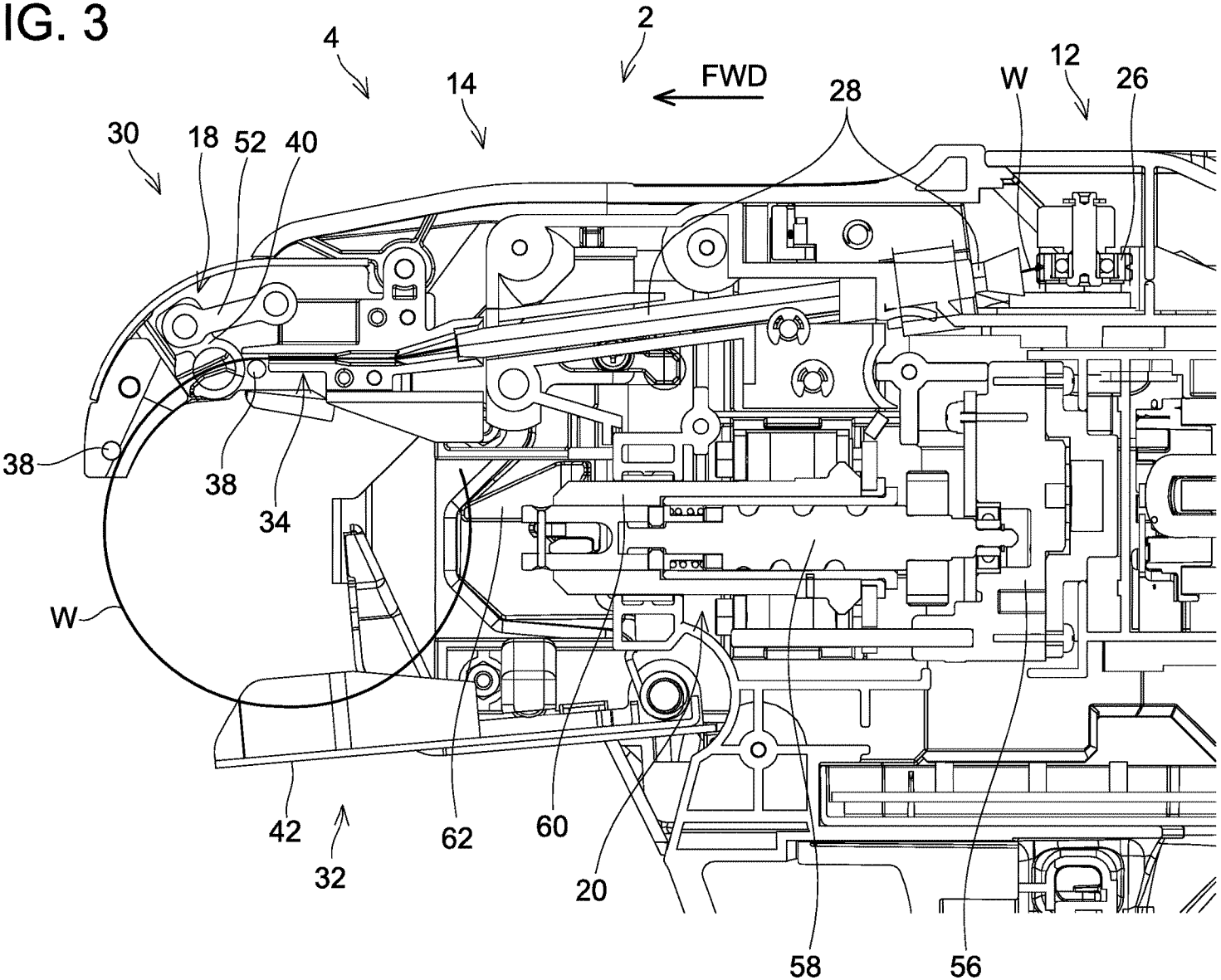
FIG. 3 is a cross-sectional view of a front part of the tying machine body 4 of the rebar tying machine 2 according to the embodiment.
Figure 4:
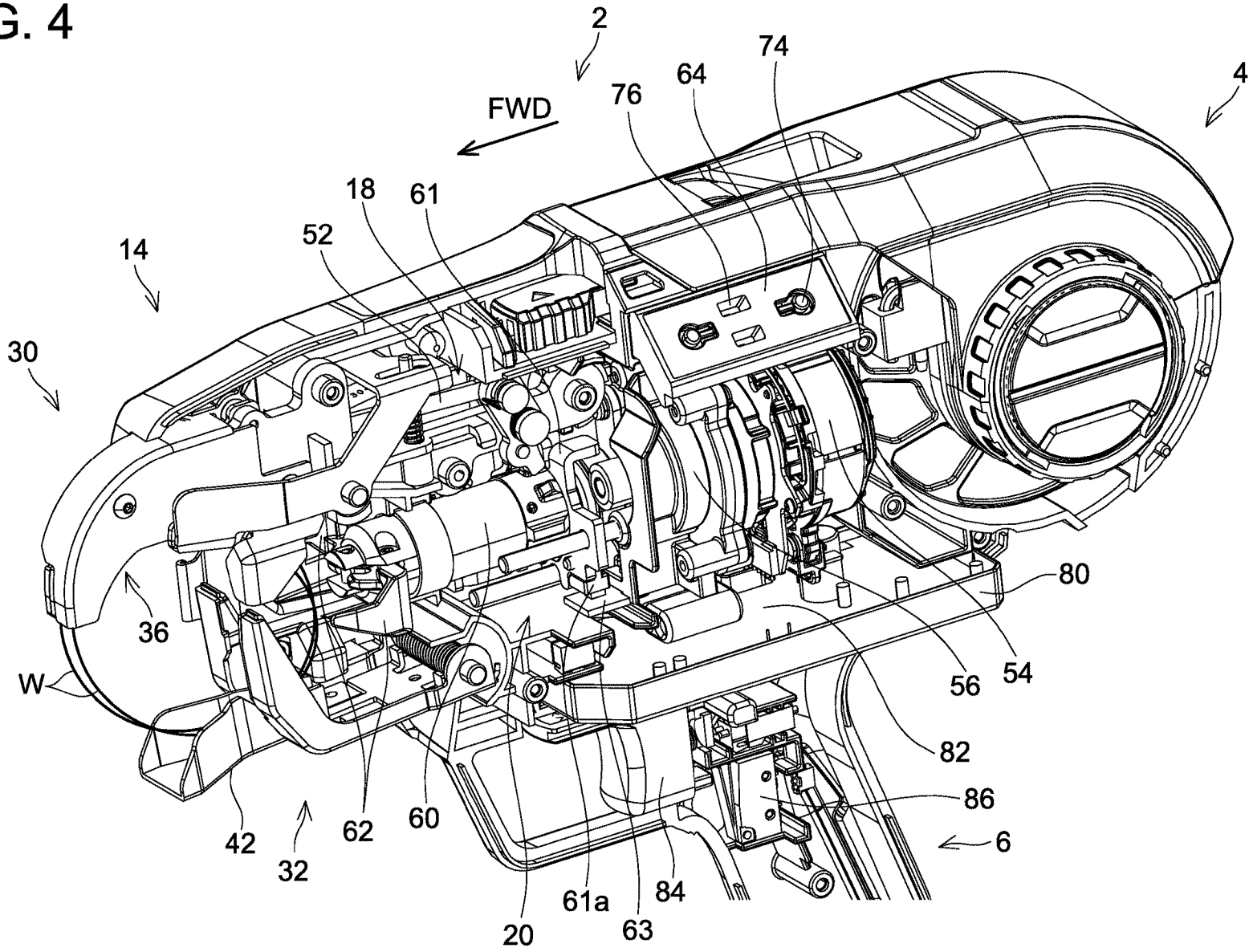
FIG. 4 is a perspective view seeing internal structures of upper parts of the tying machine body 4 and a grip 6 of the rebar tying machine 2 according to the embodiment from an upper left front side.

As shown in FIG. 2, a reel 10 on which the wire W is wound is detachably housed in an upper rear part of the tying machine body 4. As shown in FIGS. 2 to 4, the tying machine body 4 primarily includes a feeding mechanism 12, a guide mechanism 14, a braking mechanism 16, a cutter mechanism 18, and a twisting mechanism 20.

As shown in FIG. 2, the feeding mechanism 12 is configured to feed out the wire W supplied from the reel 10 to the guide mechanism 14 at a front part of the tying machine body 4. The feeding mechanism 12 is provided with a feeding motor 22, a driving roller 24, and a driven roller 26. The wire W is held between the driving roller 24 and the driven roller 26. The feeding motor 22 is a DC brush motor. The feeding motor 22 is configured to rotate the driving roller 24. When the feeding motor 22 rotates the driving roller 24, the driven roller 26 rotates in a reverse direction to a rotation direction of the driving roller 24, the wire W held by the driving roller 24 and the driven roller 26 is fed out to the guide mechanism 14, and the wire W is drawn out from the reel 10. The feeding mechanism 12 includes an encoder 27 (see FIG. 7) configured to detect a rotation angle of the driving roller 24. The feeding mechanism 12 is configured to detect a feed amount of the wire W from the rotation angle of the driving roller 24 detected by the encoder 27.

As shown in FIG. 3, the guide mechanism 14 is configured to guide the wire W fed from the feeding mechanism 12 around the rebars R in a loop. The guide mechanism 14 is provided with a guide pipe 28, an upper curl guide 30, and a lower curl guide 32. A rear end of the guide pipe 28 is open toward a space between the driving roller 24 and the driven roller 26. The wire W fed from the feeding mechanism 12 is fed into the guide pipe 28. A front end of the guide pipe 28 is open toward an inside of the upper curl guide 30. The upper curl guide 30 is provided with a first guide passage 34 for guiding the wire W fed from the guide pipe 28 and a second guide passage 36 (see FIG. 4) for guiding the wire W fed from the lower curl guide 32.

As shown in FIG. 3, the first guide passage 34 is provided with a plurality of guide pins 38 for guiding the wire W to give the wire W a downward curl, and a cutter 40 that constitutes a part of the cutter mechanism 18 to be described later. The wire W fed from the guide pipe 28 is guided by the guide pins 38 in the first guide passage 34, passes through the cutter 40, and is fed out toward the lower curl guide 32 from a front end of the upper curl guide 30.

As shown in FIG. 4, the lower curl guide 32 is provided with a feed-back plate 42. The feed-back plate 42 is configured to guide the wire W fed from the front end of the upper curl guide 30 and feed it back toward a rear end of the second guide passage 36 of the upper curl guide 30.

The second guide passage 36 of the upper curl guide 30 is arranged adjacent to the first guide passage 34 thereof. The second guide passage 36 is configured to guide the wire W fed from the lower curl guide 32 and feed it out toward the lower curl guide 32 from the front end of the upper curl guide 30.

The upper curl guide 30 and the lower curl guide 32 wrap the wire W fed from the feeding mechanism 12 around the rebars R in a loop. A number of windings of the wire W around the rebars R can be preset by a user. When the feeding mechanism 12 feeds out the wire W by a feed amount corresponding to the set number of windings, it stops the feeding motor 22 to stop feeding out of the wire W.

Figure 5:
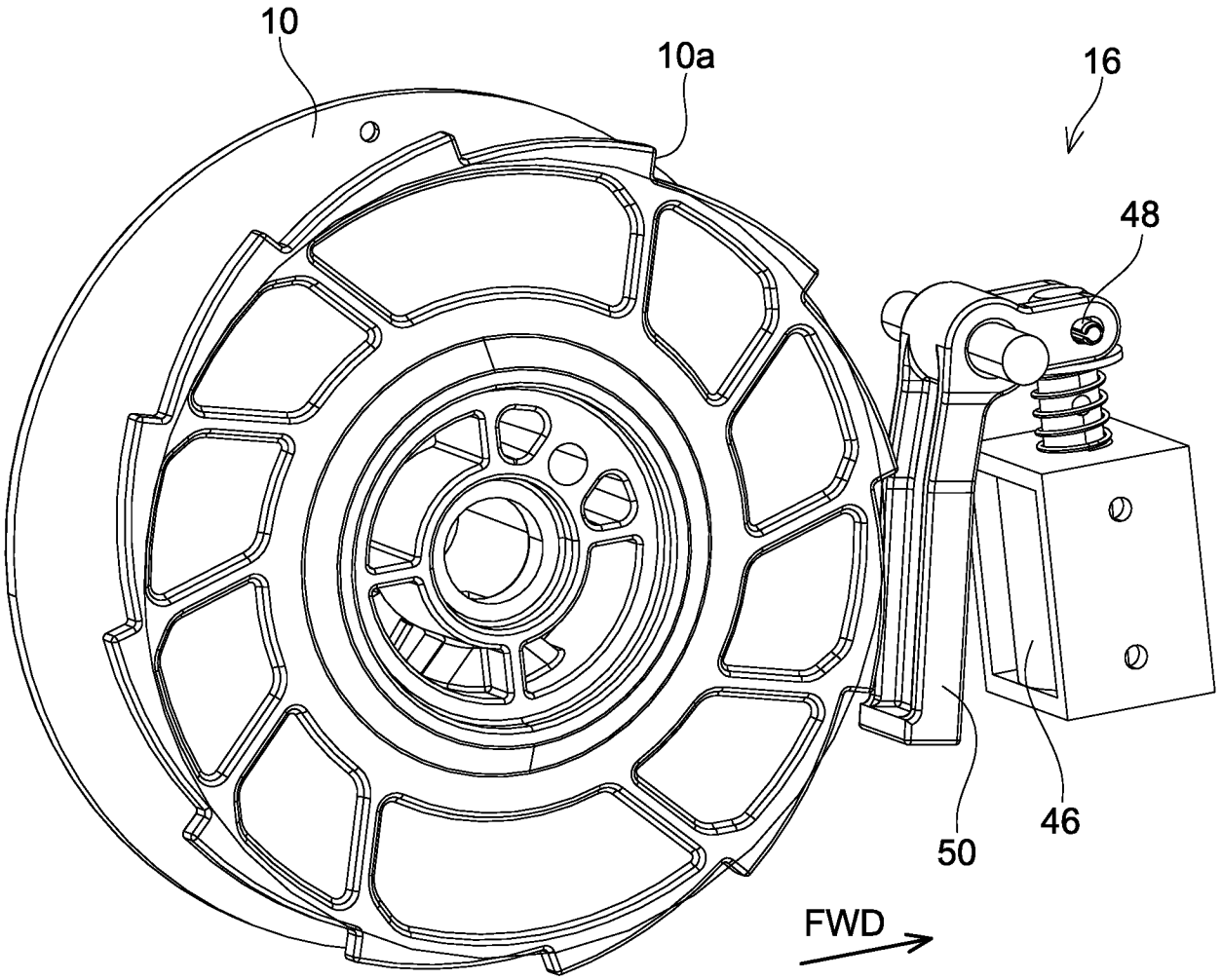
FIG. 5 is a perspective view seeing a reel 10 and a braking mechanism 16 in the rebar tying machine 2 according to the embodiment from the upper right rear side in a case where a solenoid 46 is not electrically conducted.
Figure 6:
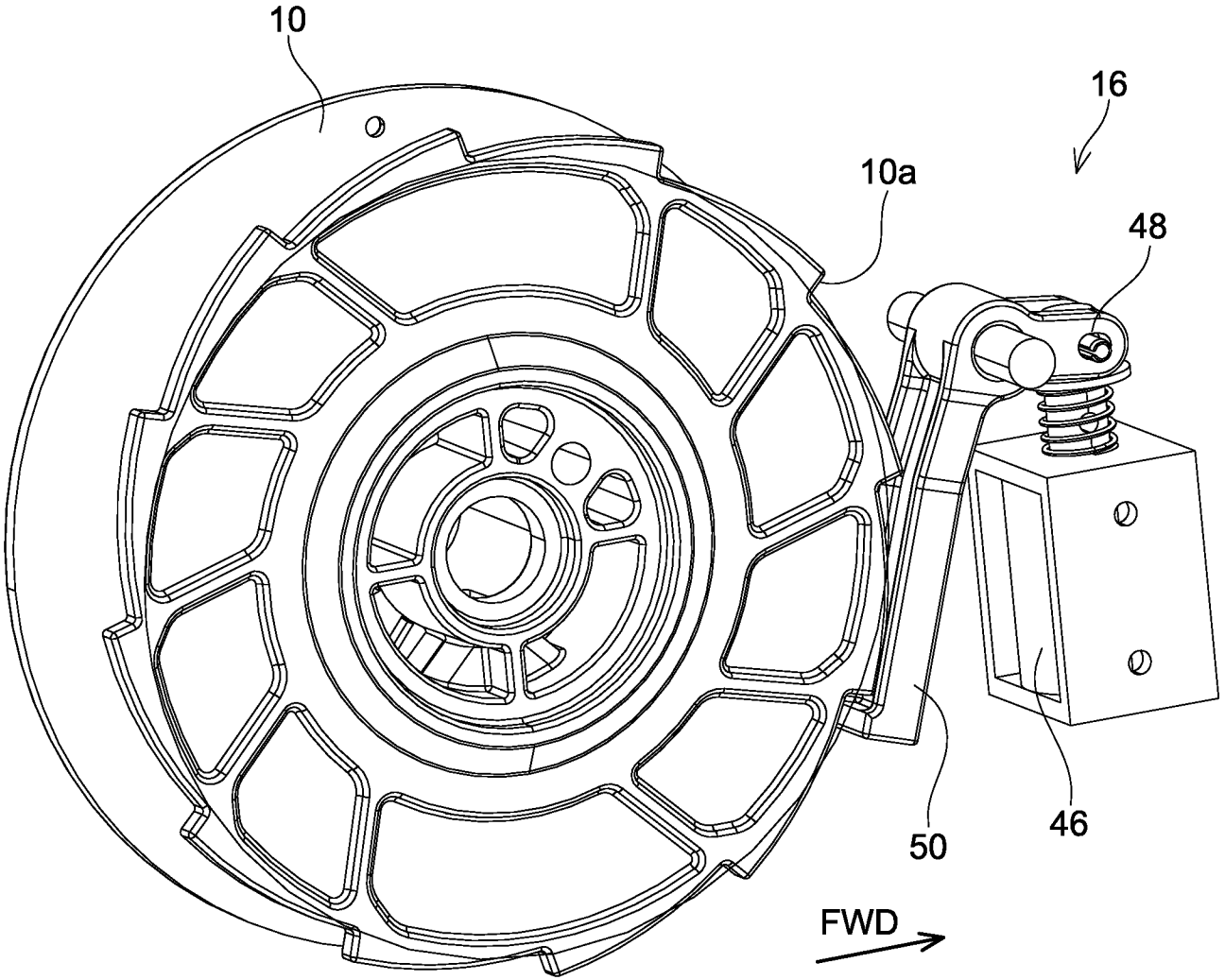
FIG. 6 is a perspective view seeing the reel 10 and the braking mechanism 16 in the rebar tying machine 2 according to the embodiment from the upper right rear side in a case where the solenoid 46 is electrically conducted.

The braking mechanism 16 shown in FIG. 2 is configured to stop rotation of the reel 10 in cooperation with the feeding mechanism 12 stopping feeding out the wire W. The braking mechanism 16 is provided with a solenoid 46, a link 48, and a brake arm 50. The reel 10 is provided with engaging portions 10*a* at predetermined angle intervals in a circumferential direction, and the brake arm 50 engages with one of the engaging portions 10*a*. As shown in FIG. 5, in a state where the solenoid 46 is not electrically conducted, the brake arm 50 is separated from the engaging portions 10*a* of the reel 10. As shown in FIG. 6, in a state where the solenoid 46 is electrically conducted, the brake arm 50 is driven via the link 48 and the brake arm 50 engages with one of the engaging portions 10*a* of the reel 10. When the feeding mechanism 12 feeds out the wire W, the braking mechanism 16 does not electrically conduct the solenoid 46 to keep the brake arm 50 separated from the engaging portions 10*a* of the reel 10 as shown in FIG. 5. Due to this, the reel 10 can rotate freely, and the feeding mechanism 12 can draw out the wire W from the reel 10. Further, when the feeding mechanism 12 stops feeding out the wire W, the braking mechanism 16 electrically conducts the solenoid 46 to bring the brake arm 50 into engagement with one of the engaging portions 10*a* of the reel 10 as shown in FIG. 6. Due to this, rotation of the reel 10 is prohibited. Due to this, the wire W can be prevented from being loose between the reel 10 and the feeding mechanism 12 due to the reel 10 continuing to rotate by inertia even after the feeding mechanism 12 has stopped feeding out the wire W.

The cutter mechanism 18 shown in FIGS. 3 and 4 cuts the wire W in a state where the wire W is wrapped around the rebars R. The cutter mechanism 18 is provided with the cutter 40 and a link 52. The link 52 rotates the cutter 40 by cooperating with the twisting mechanism 20 to be described later. The wire W that passes within the cutter 40 is cut by rotation of the cutter 40.

The twisting mechanism 20 shown in FIG. 4 is configured to tie the rebars R with the wire W by twisting the wire W wrapped around the rebars R. The twisting mechanism 20 is provided with a twisting motor 54, a reduction mechanism 56, a screw shaft 58 (see FIG. 3), a sleeve 60, a push plate 61, a pair of hooks 62, and a magnetic sensor 63.

The twisting motor 54 is a DC brushless motor. The twisting motor 54 is provided with a Hall sensor 55 (see FIG. 7) configured to detect a rotation angle of a rotor (not shown). Rotation of the twisting motor 54 is transmitted to the screw shaft 58 via the reduction mechanism 56. The twisting motor 54 is configured to rotate in both a forward direction and a reverse direction, and the screw shaft 58 is also configured to rotate in both the forward direction and the reverse direction accordingly. The sleeve 60 is disposed to cover a circumference of the screw shaft 58. In a state where rotation of the sleeve 60 is prohibited, the sleeve 60 moves forward when the screw shaft 58 rotates in the forward direction, and the sleeve 60 moves backward when the screw shaft 58 rotates in the reverse direction. The push plate 61 is configured to move integrally with the sleeve 60 according to motion of the sleeve 60 in a front-and-rear direction. Further, when the screw shaft 58 rotates in a state where the rotation of the sleeve 60 is allowed, the sleeve 60 rotates together with the screw shaft 58.

When the sleeve 60 moves forward from its initial position to a predetermined position, the push plate 61 drives the link 52 of the cutter mechanism 18 to rotate the cutter 40. The pair of hooks 62 is provided at a front end of the sleeve 60, and is configured to open and close according to the position of the sleeve 60 in the front-and-rear direction. When the sleeve 60 moves forward, the pair of hooks 62 closes to hold the wire W. After this, when the sleeve 60 moves backward, the pair of hooks 62 opens to release the wire W.

The twisting mechanism 20 rotates the twisting motor 54 in the state where the wire W is wrapped around the rebars R. In so doing, the rotation of the sleeve 60 is prohibited, and thus the sleeve 60 moves forward and the push plate 61 and the pair of hooks 62 also move forward by rotation of the screw shaft 58, and the pair of hooks 62 close to hold the wire W. Then, when the rotation of the sleeve 60 is allowed, the sleeve 60 rotates and the pair of hooks 62 also rotates by the rotation of the screw shaft 58. Due to this, the wire W is twisted and the rebars R are thereby tied.

When twisting of the wire W is finished, the twisting mechanism 20 rotates the twisting motor 54 in the reverse direction. In so doing, the rotation of the sleeve 60 is prohibited, and thus after the pair of hooks 62 opens to release the wire W, the sleeve 60 moves backward and the push plate 61 and the pair of hooks 62 also move backward by the rotation of the screw shaft 58. By the sleeve 60 moving backward, the push plate 61 drives the link 52 of the cutter mechanism 18 to bring the cutter 40 back to its initial orientation. After this, when the sleeve 60 moves back to the initial position, the rotation of the sleeve 60 is allowed, by which the sleeve 60 and the pair of hooks 62 rotate by the rotation of the screw shaft 58 and return to their initial angle. The magnetic sensor 63 has its position in the front-and-rear direction fixed, and is configured to detect magnetism from a magnet 61*a* provided on the push plate 61 to defect whether or not the sleeve 60 is at its initial position.

As shown in FIG. 1, a first operation unit 64 is provided at an upper part of the tying machine body 4. The first operation unit 64 is provided with a main switch 74 configured to switch on/off of a main power, and a main power LED 76 configured to display an on/off state of the main power. The main switch 74 is a momentary switch that is normally off and is turned on while it is being pressed by the user.

A second operation unit 90 is provided on an upper front surface of the battery receiving unit 8. The user can set a number of windings of the wire W around the rebars R and a torque threshold for twisting the wire W via the second operation unit 90. The second operation unit 90 is provided with setting switches 98 for setting the number of windings of the wire W around the rebars R and the torque threshold for twisting the wire W, display LEDs 96 for displaying current setting contents, and the like. The setting switches 98 and the display LEDs 96 are integrated in a sub-circuit board 92 (see FIG. 7) housed inside the battery receiving unit 8.

A trigger 84 which the user can operate to pull is provided at an upper front part of the grip 6. As shown in FIG. 4, a trigger switch 86 configured to detect on/off of the trigger 84 is provided inside the grip 6. When the user pulls the trigger 84 and the trigger switch 86 is turned on, the rebar tying machine 2 performs a series of operations to wrap the wire W around the rebars R by the feeding mechanism 12, the guide mechanism 14, and the braking mechanism 16, cut the wire W and twist the wire W wrapped around the rebars R by the cutter mechanism 18 and the twisting mechanism 20.

As shown in FIG. 4, a main circuit board casing 80 is housed at a lower part inside the tying machine body 4. A main circuit board 82 is housed inside the main circuit board casing 80.

Figure 7:
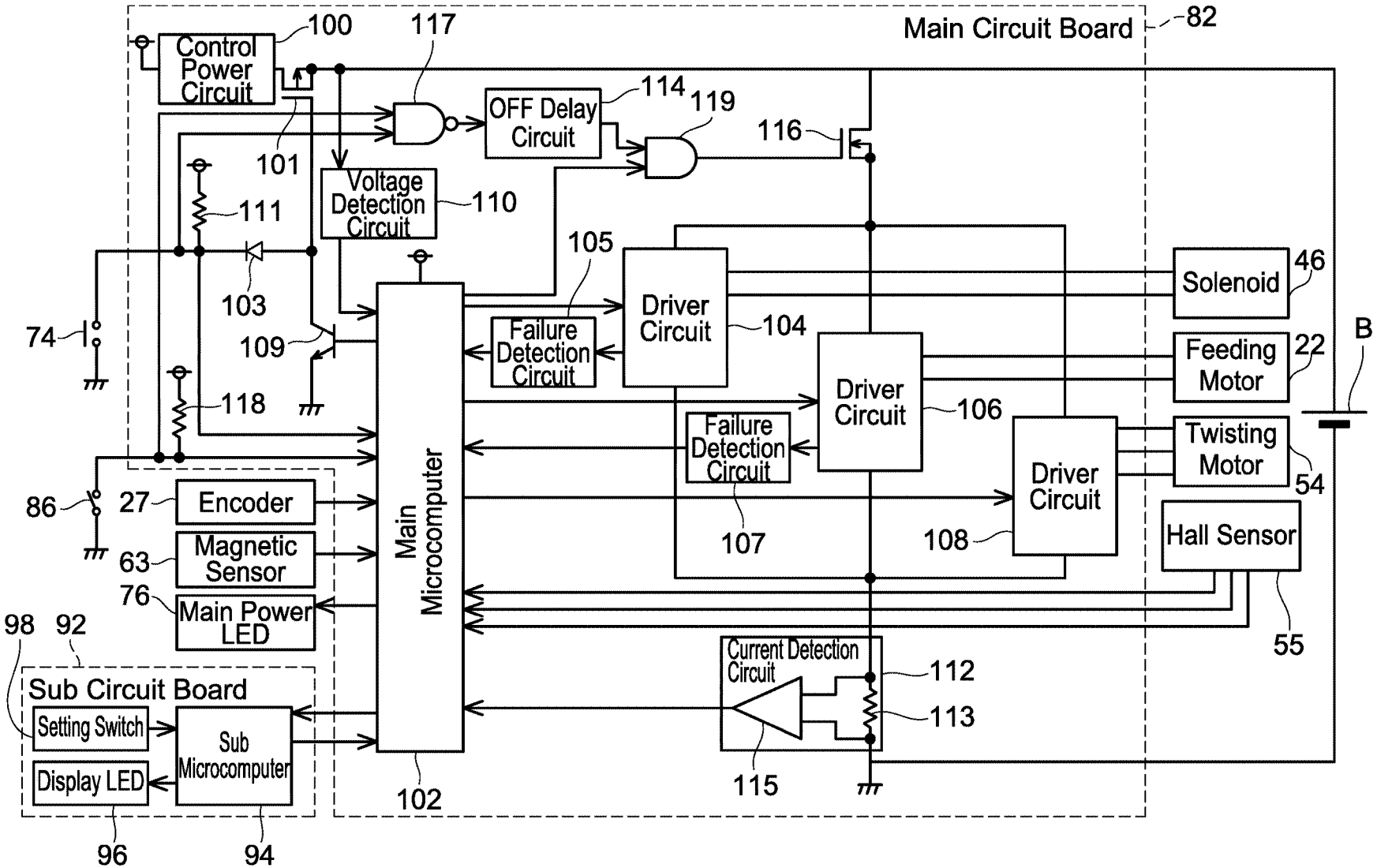
FIG. 7 is a block diagram showing an electric system of the rebar tying machine 2 according to the embodiment.

As shown in FIG. 7, the main circuit board 82 is provided with a control power circuit 100, a main microcomputer 102, driver circuits 104, 106, 108, failure detection circuits 105, 107, a voltage detection circuit 110, a current detection circuit 112, an off-delay circuit 114, and the like. Further, the sub-circuit board 92 is provided with a sub microcomputer 94, the display LEDs 96, the setting switches 98, and the like. The main microcomputer 102 of the main circuit board 82 and the sub microcomputer 94 of the sub-circuit board 92 are configured to communicate with each other via a serial communication. The sub microcomputer 94 is configured to send contents inputted from the setting switches 98 to the main microcomputer 102, and to control operations of the display LEDs 96 according to instructions from the main microcomputer 102.

The control power circuit 100 adjusts power supplied from the battery B to a predetermined voltage and supplies power to the main microcomputer 102 and the sub microcomputer 94. A passage through which the power is supplied from the battery B to the control power circuit 100 is provided with a main power FET 101. When the main power FET 101 is turned on, power supply from the battery B to the control power circuit 100 is performed. When the main power FET 101 is turned off, the power supply from the battery B to the control power circuit 100 is cut off. In the disclosure herein, a state in which the power supply from the battery B to the control power circuit 100 is being performed is termed a state where the main power of the rebar tying machine 2 is on. Further, in the disclosure herein, a state in which the power supply from the battery B to the control power circuit 100 is not being performed is termed a state where the main power of the rebar tying machine 2 is off. A control input of the main power FET 101 is connected to a ground potential via a diode 103 and the main switch 74. Further, the control input of the main power FET 101 is connected to a ground potential via a transistor 109. Switching between on and off of the transistor 109 is executed by the main microcomputer 102. The main switch 74 is connected to a power source potential via a resistor 111. The main microcomputer 102 can identify the on/off state of the main switch 74 from a potential of a connection between the main switch 74 and the resistor 111. Further, the trigger switch 86 has its one end connected to a ground potential and the other end connected to a power source potential via a resistor 118. The main microcomputer 102 can identify the on/off state of the trigger switch 86 from a potential of a connection between the trigger switch 86 and the resistor 118.

When the main switch 74 switches from off to on while the main power FET 101 is in the off state (that is, the main power of the rebar tying machine 2 is in the off state), the main power FET 101 switches to the on state. Due to this, the power supply from the battery B to the control power circuit 100 is performed, and the main power of the rebar tying machine 2 is turned on. When the power supply is performed from the control power circuit 100 to the main microcomputer 102, the main microcomputer 102 starts up and the main microcomputer 102 identifies that the main switch 74 is being pressed. In this case, the main microcomputer 102 switches the transistor 109 to the on state. Even when the main switch 74 switches from on to off in this state, the main power FET 101 is maintained in the on state by the transistor 109.

Further, when the main switch 74 switches from off to on while the main power FET 101 is in the on state (that is, the main power of the rebar tying machine 2 is in the on state), the main microcomputer 102 identifies that the main switch 74 is pressed. In this case, the main microcomputer 102 executes processes which should be executed before turning off the main power of the rebar tying machine 2, and then switches the transistor 109 to the off state. After this, when the main switch 74 switches from on to off, the main power FET 101 switches to the off state, and the power supply from battery B to the control power circuit 100 is cut off. Due to this, the power supply to the main microcomputer 102 is cut off, and the main power of the rebar tying machine 2 is turned off.

The driver circuit 104 is configured to drive the solenoid 46 in accordance with an instruction from the main microcomputer 102. Although not shown, the driver circuit 104 includes one FET as a switching element. The main microcomputer 102 can control operations of the solenoid 46 through the driver circuit 104.

The failure detection circuit 105 is provided corresponding to the driver circuit 104. The failure detection circuit 105 is configured to output a failure detection signal to the main microcomputer 102 in a case where the FET in the driver circuit 104 fails.

The driver circuit 106 is configured to drive the feeding motor 22 in accordance with an instruction from the main microcomputer 102. Although not shown, the driver circuit 106 includes two FETs as switching elements. The main microcomputer 102 can control operations of the feeding motor 22 through the driver circuit 106.

The failure detection circuit 107 is provided corresponding to the driver circuit 106. The failure detection circuit 107 is configured to output a failure detection signal to the main microcomputer 102 in a case where at least one of the FETs in the driver circuit 106 fail.

The driver circuit 108 is configured to drive the twisting motor 54 in accordance with an instruction from the main microcomputer 102. Although not shown, the driver circuit 108 includes an inverter circuit provided with six FETs as switching elements. The main microcomputer 102 can control operations of the twisting motor 54 by controlling operations of the inverter circuit in the driver circuit 108 based on a detection signal from the Hall sensor 55. Unlike the driver circuits 104, 106, the driver circuit 108 is not provided with a failure detection circuit for detecting failures of the FETs. This is because even when one or more of the FETs constituting the inverter circuit of the driver circuit 108 fail, the driver circuit 108 does not allow the twisting motor 54 to keep rotating.

The voltage detection circuit 110 is configured to detect the voltage of the battery B. The main microcomputer 102 can obtain the voltage of the battery B from a signal received from the voltage detection circuit 110.

The current detection circuit 112 is configured to detect currents supplied from the battery B to the driver circuits 104, 106, 108. The current detection circuit 112 is provided with a resistor 113 and an amplifier 115 configured to amplify a voltage drop in the resistor 113 and output the same to the main microcomputer 102. The main microcomputer 102 can obtain the currents supplied to the driver circuits 104, 106, 108 from the battery B, that is, the currents supplied to the twisting motor 54, the feeding motor 22, the solenoid 46, and the like from the battery B, based on signals received from the current detection circuit 112.

A passage through which the power is supplied from the battery B to the driver circuits 104, 106, 108 is provided with a protective FET 116. When the protective FET 116 is turned on, the power supply from the battery B to the driver circuits 104, 106, 108 is performed. When the protective FET 116 is turned off, the power supply from the battery B to the driver circuits 104, 106, 108 is cut off. An output of an AND circuit 119 is connected to a control input of the protective FET 116. A control output from the main microcomputer 102 and an output from the off-delay circuit 114 are inputted to the AND circuit 119. Due to this, the protective FET 116 shifts to an on state when an H signal is outputted from the main microcomputer 102 as the control output and an H signal is outputted from the off-delay circuit 114. Further, the protective FET 116 shifts to an off state when an L signal is outputted from the main microcomputer 102 as the control output or an L signal is outputted from the off-delay circuit 114. A control output from the sub microcomputer 94 may further be inputted to an input of the AND circuit 119. In this case, the protective FET 116 shifts to the on state when the H signal is outputted from the main microcomputer 102 as the control output, an H signal is outputted from the sub microcomputer 94 as the control output, and the H signal is outputted from the off-delay circuit 114, and shifts to the off state otherwise.

The off-delay circuit 114 is configured to normally output the H signal and output the L signal after a predetermined delay time has elapsed since the main switch 74 or the trigger switch 86 switched from on to off. When the off-delay circuit 114 outputs the L signal, the protective FET 116 switches to the off state regardless of contents of the control output from the main microcomputer 102. The delay time of the off-delay circuit 114 is preset to a time that is longer than a required time for a tying process (wire feeding process, wire twisting process, and initial position returning process) to be described later. An output of a NAND circuit 117 is connected to an input of the off-delay circuit 114. One input of the NAND circuit 117 is connected to the ground potential via the main switch 74, and the other input of the NAND circuit 117 is connected to the ground potential via the trigger switch 86.

In the rebar tying machine 2 of the present embodiment, presences and absences of the power supply to the driver circuits 104, 106, 108 can be controlled by the single protective FET 116. With such a configuration, a number of components can be reduced as compared to a case where protective FETs individually corresponding to the driver circuits 104, 106, 108 are provided, and a space in the main circuit board 82 can be reduced.

In the rebar tying machine 2 of the present embodiment, the protective FET 116 is turned off by the output from the off-delay circuit 114 regardless of the contents of the control output from the main microcomputer 102 after the predetermined delay time has elapsed since the main switch 74 or the trigger switch 86 switched from on to off, by which the power supply to the driver circuits 104, 106, 108 is cut off. With such a configuration, the solenoid 46, the feeding motor 22, and the twisting motor 54 can be prevented from continuing to be driven if the main microcomputer 102 goes out of control.

In the rebar tying machine 2 of the present embodiment, the presence and absence of the power supply from the battery B to the driver circuits 104, 106, 108 is controlled by the protective FET 116 that operates according to the output control from the main microcomputer 102, instead of by a mechanical switching mechanism. With such a configuration, even in a case where the main switch 74 is operated (that is, an operation to turn off the main power of the rebar tying machine 2 is performed) during the tying process (the wire feeding process, the wire twisting process, and the initial position returning process) to be described later, the power supply from the battery B to the driver circuits 104, 106, 108 is not cut off immediately at this time point, and the power supply from the battery B to the driver circuits 104, 106, 108 can be cut off after completion of necessary operations.

In the rebar tying machine 2 of the present embodiment, a momentary switch is used as the main switch 74. With such a configuration, in a case where the main power of the rebar tying machine 2 is switched from on to off due to a cause other than the operation of the main switch 74 (for example, in a case where, as an automatic power-off function, the main power of the rebar tying machine 2 is turned off because the main microcomputer 102 switches the transistor 109 to an off state due to the main switch 74 and the trigger switch 86 not being operated over a predetermined time period), an operation for switching the main power of the rebar tying machine 2 to on again from off can be simplified.

Hereinbelow, processes which the main microcomputer 102 executes will be described with reference to FIG. 8. When the main power FET 101 is turned on according to the operation on the main switch 74 and the power is supplied from the control power circuit 100 to the main microcomputer 102, the main microcomputer 102 executes the initialization process in step S2. After this, in step S4, the main microcomputer 102 waits until the trigger switch 86 is turned on. When the trigger switch 86 is turned on (YES in S4), the process proceeds to step S6, and the main microcomputer 102 executes the tying process. After this, the process returns to step S4.

Figure 8:
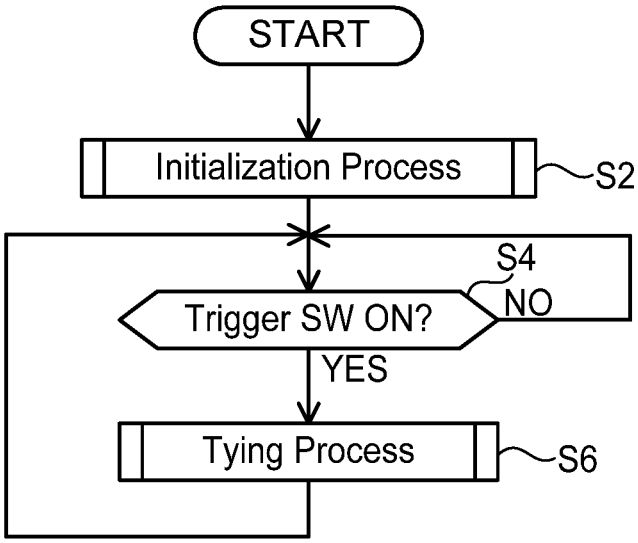
FIG. 8 is a flowchart explaining an example of processes which a main microcomputer 102 executes in the rebar tying machine 2 according to the embodiment.
Figure 9:
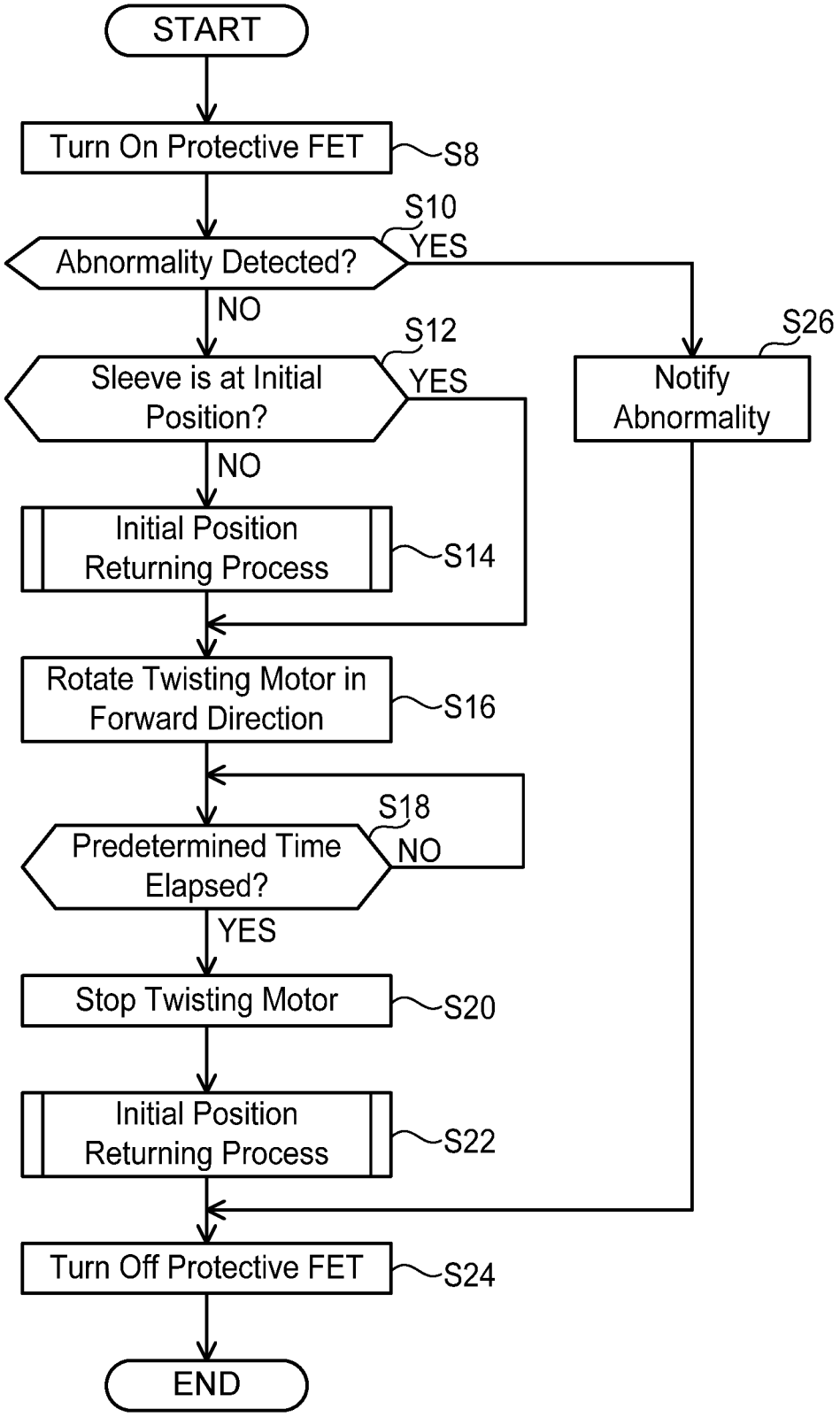
FIG. 9 is a flowchart explaining an example of an initialization process which the main microcomputer 102 executes in the rebar tying machine 2 according to the embodiment

FIG. 9 shows a process which the main microcomputer 102 executes in the initialization process in step S2 of FIG. 8. In step S8, the main microcomputer 102 turns on the protective FET 116. Due to this, the power supply from the battery B to the driver circuits 104, 106, 108 is performed.

In step S10, the main microcomputer 102 determines whether or not an abnormality is detected. For example, the main microcomputer 102 may determine that an abnormality is detected in a case where a failure of one of the FETs in the driver circuits 104, 106 is detected by the failure detection circuit 105 or 107. Alternatively, the main microcomputer 102 may determine that an abnormality is detected in a case where the voltage of the battery B detected by the voltage detection circuit 110 is below a predetermined lower limit. Alternatively, the main microcomputer 102 may determine that an abnormality is detected in a case where the voltage of the battery B detected by the voltage detection circuit 112 exceeds a predetermined upper limit. Alternatively, in a case where the rebar tying machine 2 is provided with a wire remaining amount detection mechanism (not shown) for detecting a remaining amount of the wire W wound on the reel 10, the main microcomputer 102 may determine that an abnormality is detected in a case where the remaining amount of the wire W wound on the reel 10 is below a predetermined lower limit.

In a case where an abnormality is detected in step S10 (in a case of YES), the process proceeds to step S26. In step S26, the main microcomputer 102 displays the occurrence of the abnormality on the display LEDs 96 via the sub microcomputer 94. After step S26, the process proceeds to step S24. In step S24, the main microcomputer 102 turns off the protective FET 116. Due to this, the power supply from the battery B to the driver circuits 104, 106, 108 is cut off. After step S24, the initialization process of FIG. 9 is terminated. The process in step S10 may be executed at any time while processes of steps S12 to S22 are being executed.

In a case where no abnormality is detected in step S10 (in a case of NO), the process proceeds to step S12. In step S12, the main microcomputer 102 determines whether or not the sleeve 60 of the twisting mechanism 20 is at the initial position. Whether or not the sleeve 60 is at the initial position can be determined from the detection signal of the magnetic sensor 63. In a case where the sleeve 60 is at the initial position (in a case of YES), the initial position returning process in step S14 is skipped, and the process proceeds to step S16. In a case where the sleeve 60 is not at the initial position (in a case of NO), the process proceeds to step S16 after the initial position returning process in step S14 has been executed.

Figure 10:
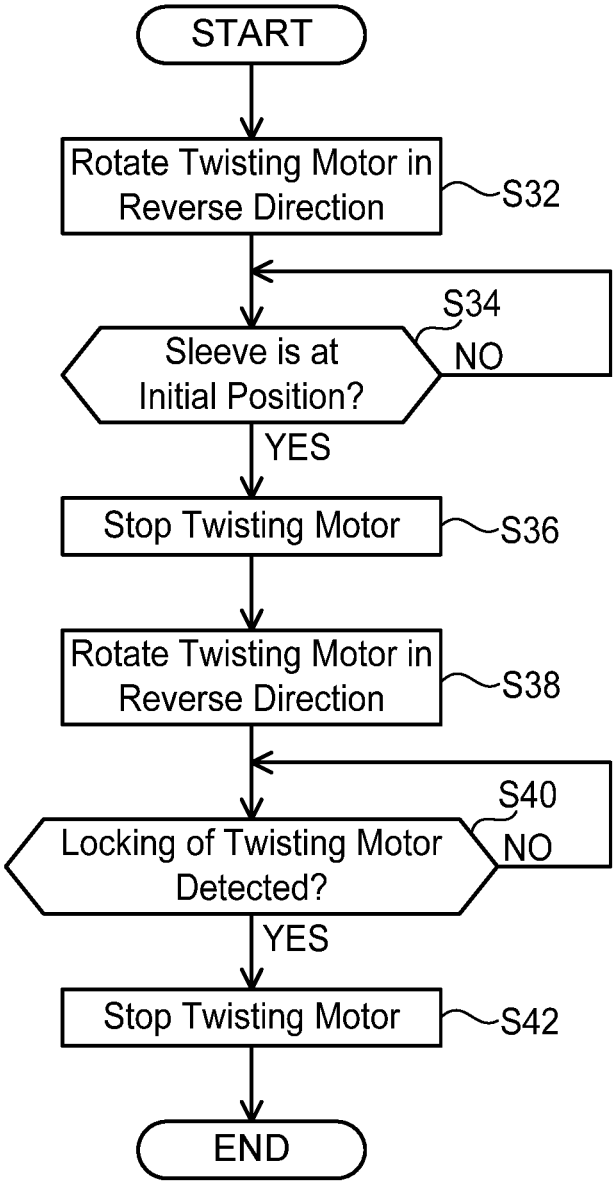
FIG. 10 is a flowchart explaining an example of an initial position returning process which the main microcomputer 102 executes in the rebar tying machine 2 according to the embodiment.

FIG. 10 shows processes which the main microcomputer 102 executes in the initial position returning process in step S14 of FIG. 9.

In step S32, the main microcomputer 102 rotates the twisting motor 54 in the reverse direction. Due to this, the sleeve 60 located forward than the initial position moves backward.

In step S34, the main microcomputer 102 waits until the sleeve 60 moves back to the initial position. When the sleeve 60 moves back to the initial position (YES in S34), the main microcomputer 102 stops the twisting motor 54 in step S36.

In step S38, the main microcomputer 102 further rotates the twisting motor 54 in the reverse direction. An instructed voltage to the twisting motor 54 at this timing is lower than an instructed voltage to the twisting motor 54 in step S32. As such, the twisting motor 54 rotates at a lower speed than its rotation in step S32. Due to this, the sleeve 60, which moved backward to the initial position and is allowed to rotate, rotates toward its initial angle.

In step S40, the main microcomputer 102 determines whether or not the sleeve 60 has rotated to the initial angle and the twisting motor 54 is locked. For example, the main microcomputer 102 detects the current supplied from the battery B to the twisting motor 54 by the current detection circuit 112, and determines that the twisting motor 54 is locked when the detected current is equal to or greater than a predetermined value. When it is determined that the twisting motor 54 is locked (YES in S40), the main microcomputer 102 stops the twisting motor 54 in step S42, and terminates the initial position returning process of FIG. 10.

In a case where the operation on the main switch 74 is performed (that is, the operation to turn off the main power of the rebar tying machine 2 is performed) during when the initial position returning process shown in FIG. 10 is being executed, the main microcomputer 102 stops the twisting motor 54 at that instant and switches the protective FET 116 to off, and further switches the transistor 109 to off to turn off the main power of the rebar tying machine 2.

In step S16 of FIG. 9, the main microcomputer 102 rotates the twisting motor 54 in the forward direction. Due to this, the sleeve 60 moves forward from the initial position.

In step S18, the main microcomputer 102 waits until a predetermined time period (such as 200 ms) elapses. When the predetermined time period elapses (YES in S18), the process proceeds to step S20.

In step S20, the main microcomputer 102 stops the twisting motor 54.

In step S22, the main microcomputer 102 executes the initial position returning process shown in FIG. 10 again.

In step S24, the main microcomputer 102 turns off the protective FET 116. Due to this, the power supply from the battery B to the driver circuits 104, 106, 108 is cut off. After step S24, the initialization process of FIG. 9 is terminated.

Figure 11:
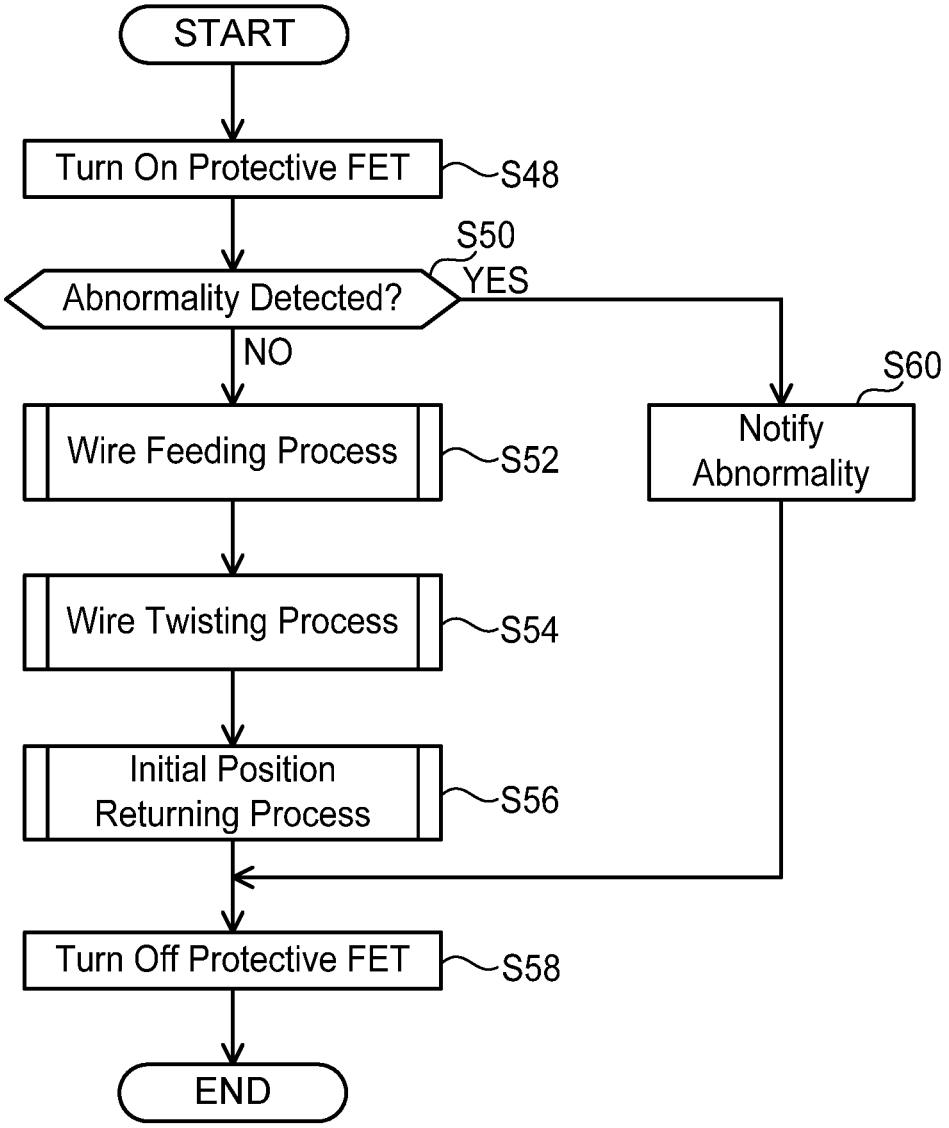
FIG. 11 is a flowchart explaining an example of a tying process which the main microcomputer 102 executes in the rebar tying machine 2 according to the embodiment.

Hereinbelow, the tying process in step S6 of FIG. 8 will be described. FIG. 11 shows processes which the main microcomputer 102 executes in the tying process in step S6 of FIG. 8. In step S48, the main microcomputer 102 turns on the protective FET 116. Due to this, the power from the battery B is supplied to the driver circuits 104, 106, 108.

In step S50, the main microcomputer 102 determines whether or not an abnormality is detected. For example, the main microcomputer 102 may determine that an abnormality is detected in the case where a failure of one of the FETs in the driver circuits 104, 106 is detected by the failure detection circuit 105 or 107. Alternatively, the main microcomputer 102 may determine that an abnormality is detected in the case where the voltage of the battery B detected by the voltage detection circuit 110 is below the predetermined lower limit. Alternatively, the main microcomputer 102 may determine that an abnormality is detected in a case where the current of the battery B detected by the current detection circuit 112 exceeds a predetermined upper limit. Alternatively, in the case where the rebar tying machine 2 is provided with the wire remaining amount detection mechanism (not shown) for detecting the remaining amount of the wire W wound on the reel 10, the main microcomputer 102 may determine that an abnormality is detected in the case where the remaining amount of the wire W wound on the reel 10 is below the predetermined lower limit.

In a case where an abnormality is detected in step S50 (in a case of YES), the process proceeds to step S60. In step S60, the main microcomputer 102 displays the occurrence of the abnormality on the display LEDs 96 via the sub microcomputer 94. After step S60, the process proceeds to step S58. In step S58, the main microcomputer 102 turns off the protective FET 116. Due to this, the power supply from the battery B to the driver circuits 104, 106, 108 is cut off. After step S58, the tying process of FIG. 11 is terminated. The process in step S50 may be executed at any time while processes of steps S52 to S56 are being executed.

In a case where no abnormality is detected in step S50 (in a case of NO), the process proceeds to step S52. In step S52, the main microcomputer 102 executes the wire feeding process. After this, in step S54, the main microcomputer 102 executes the wire twisting process. After this, in step S56, the main microcomputer 102 executes the initial position returning process shown in FIG. 10. In step S58, the main microcomputer 102 turns off the protective FET 116. Due to this, the power supply from the battery B to the driver circuits 104, 106, 108 is cut off. After step S58, the tying process of FIG. 11 is terminated.

Figure 12:
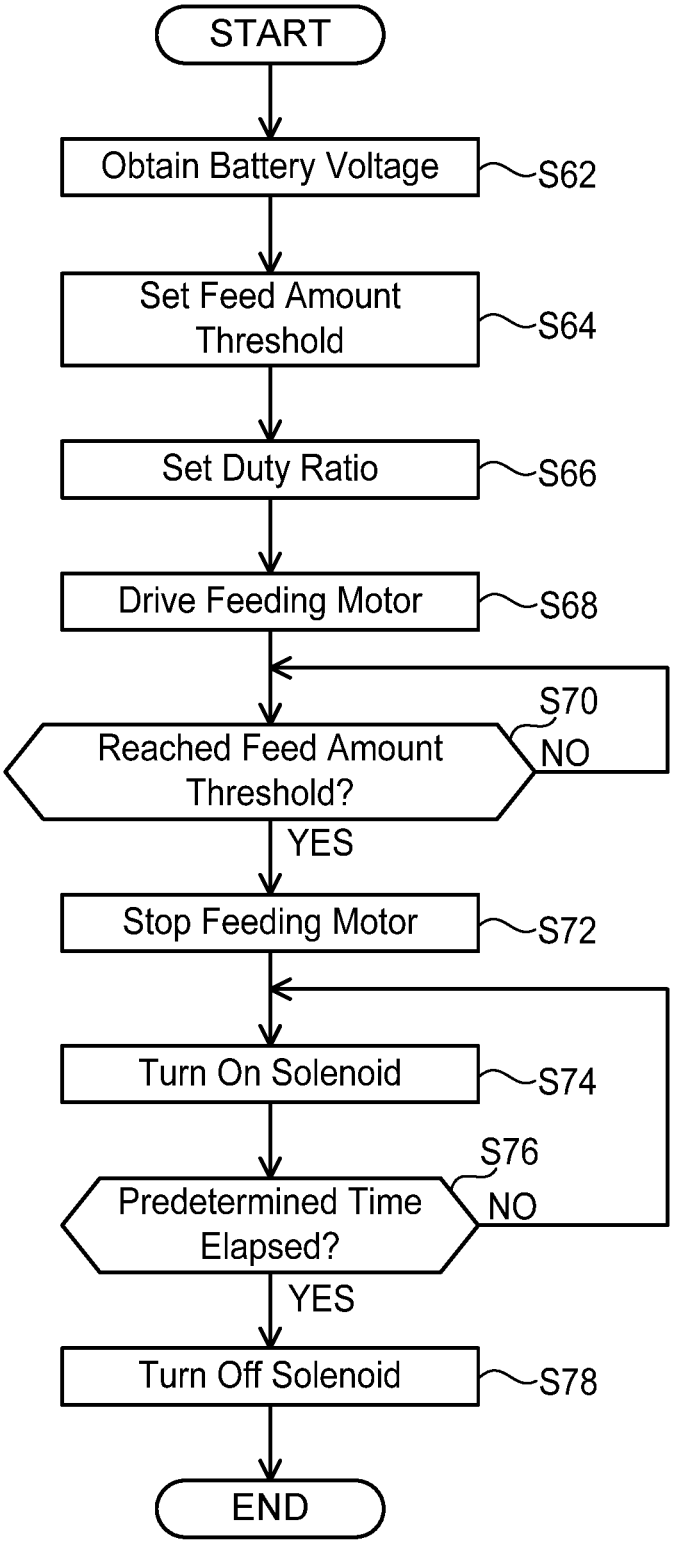
FIG. 12 is a flowchart explaining an example of a wire feeding process which the main microcomputer 102 executes in the rebar tying machine 2 according to the embodiment.

FIG. 12 shows processes which the main microcomputer 102 executes in the wire feeding process in step S52 of FIG. 11.

In step S62, the main microcomputer 102 detects the voltage of the battery B by the voltage detection circuit 110. At this time point, since none of the twisting motor 54, the feeding motor 22, and the solenoid 46 is driven, the voltage obtained in step S62 is an open voltage of the battery B.

In step S64, the main microcomputer 102 sets a feed amount threshold of the wire W based on the number of windings of the wire W set by the user and the voltage of the battery B obtained in step S62. In so doing, the main microcomputer 102 sets the feed amount threshold of the wire W to a small value when the voltage of the battery B is high, and sets the feed amount threshold of the wire W to a large value when the voltage of the battery B is low.

In step S66, the main microcomputer 102 sets a duty ratio for driving the feeding motor 22 based on the voltage of the battery B obtained in step S62. Specifically, the main microcomputer 102 sets the duty ratio according to the voltage of the battery B obtained in step S62 so that an average applied voltage to the feeding motor 22 comes to be at a predetermined value.

In step S68, the main microcomputer 102 drives the feeding motor 22 at the duty ratio set in step S66. Due to this, the feeding motor 22 rotates and the wire W is thereby fed out.

In step S70, the main microcomputer 102 waits until the feed amount of the wire W reaches the feed amount threshold set in step S64. The feed amount of the wire W can be calculated based on a detection vale of the encoder 27 of the feeding mechanism 12. When the feed amount of the wire W reaches the feed amount threshold (YES in S70), the process proceeds to step S72.

In step S72, the main microcomputer 102 stops the feeding motor 22. The feeding motor 22 stops after rotating for a while by inertia.

In step S74, the main microcomputer 102 electrically conducts the solenoid 46 of the braking mechanism 16. Due to this, the brake arm 50 is driven through the link 48.

In step S76, the main microcomputer 102 waits until a predetermined time elapses. During this time, the brake arm 50 of the braking mechanism 16 engages with one of the engaging portions 10*a* of the reel 10 and the rotation of the reel 10 stops. When the predetermined time elapses in step S76 (YES in S76), the process proceeds to step S78.

In step S78, the main microcomputer 102 cuts off electric conduction to the solenoid 46 of the braking mechanism 16. Due to this, the brake arm 50 separates from the engaging portion 10*a* of the reel 10. After step S78, the wire feeding process of FIG. 12 is terminated.

Figure 13A:
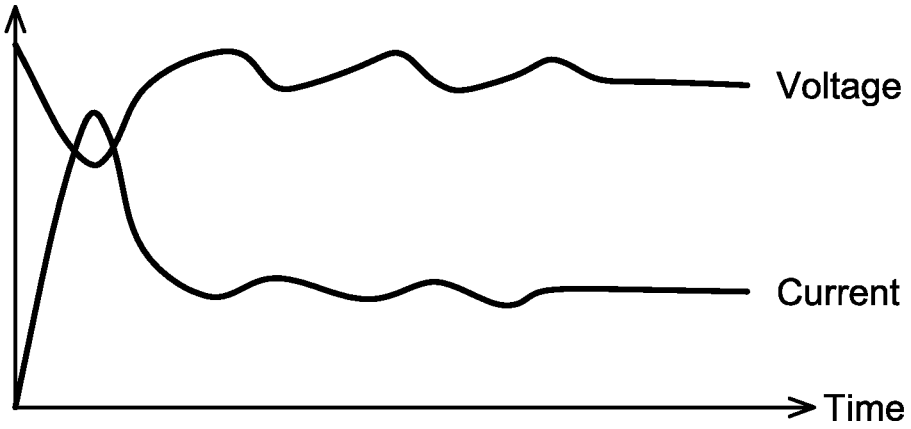
FIGS. 13A and 13B are graphs showing relationships of a voltage of a battery B, a current supplied from the battery B, and a rotation speed of a feeding motor 22 in the wire feeding process of FIG. 12.
Figure 13B:
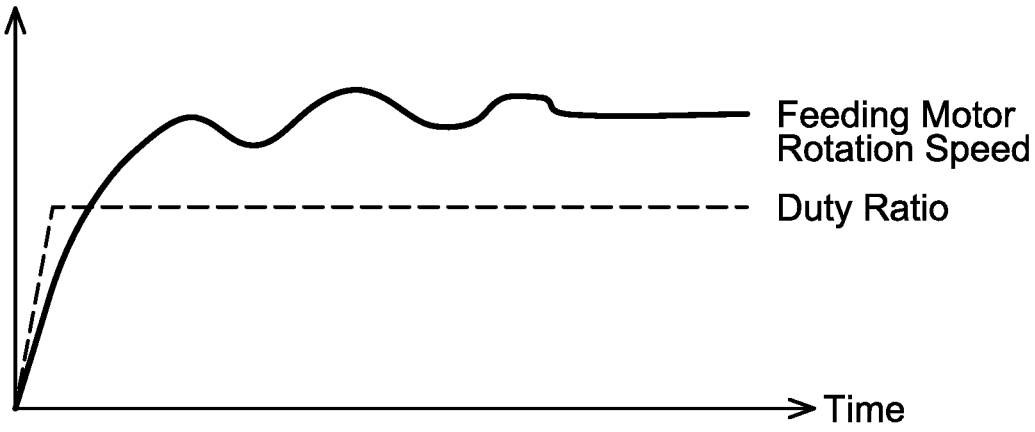

As shown in FIG. 13A, the voltage of the battery B and the current supplied from the battery B change over time upon driving the feeding motor 22. When the rotation speed of the feeding motor 22 changes due to such changes in the voltage of the battery B, a degree of the rotation of the feeding motor 22 by inertia since the main microcomputer 102 outputted a stop instruction to the feeding motor 22 until the feeding motor 22 actually stops changes, by which a final feed amount of the wire W would thereby vary. According to the wire feeding process shown in FIG. 12, the duty ratio of the feeding motor 22 is set based on the open voltage of the battery B before the feeding motor 22 is driven and the feeding motor 22 is kept driven by the constant duty ratio, by which the variation in the rotation speed of the feeding motor 22 can be suppressed as shown in FIG. 13B. With such a configuration, the variation in the feed amount of the wire W accompanying the variation in the voltage of the battery B can be suppressed.

Figure 14A:
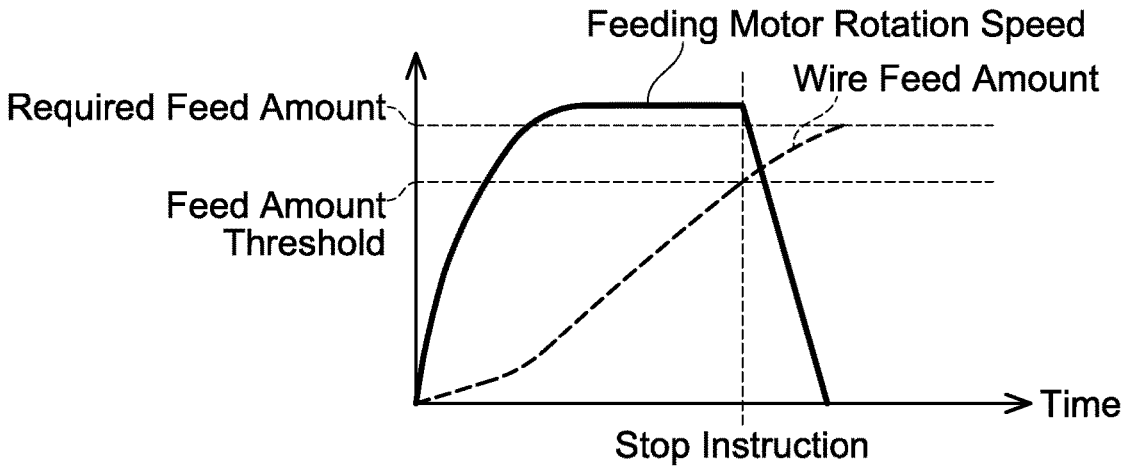
FIGS. 14A and 14B are graphs showing relationships of the rotation speed of the feeding motor 22 and a feed amount of a wire W in the wire feeding process of FIG. 12.
Figure 14B:
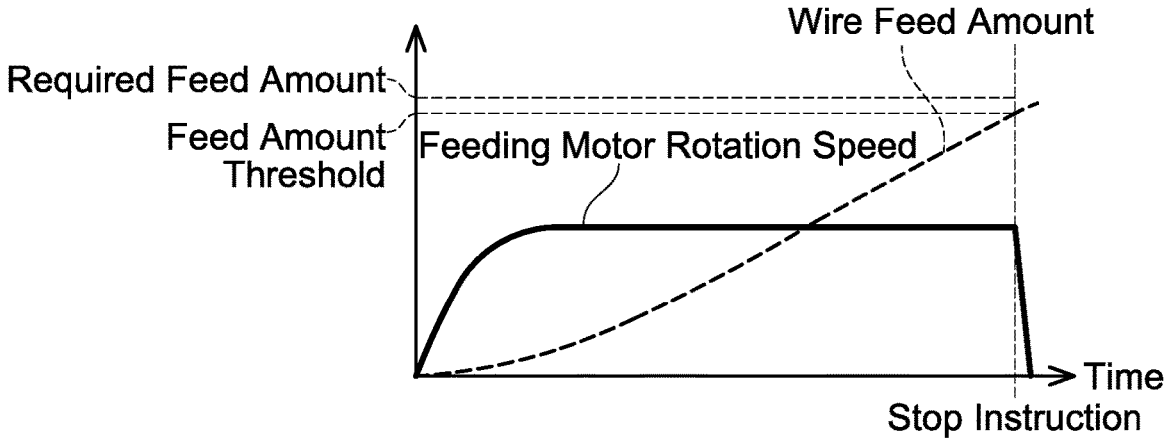

Further, in the wire feeding process shown in FIG. 12, the feed amount threshold of the wire W is set based on the open voltage of the battery B before the feeding motor 22 is driven. In a case where the voltage of the battery B is high, as shown in FIG. 14A, the applied voltage to the feeding motor 22 becomes high and the rotation speed of the feeding motor 22 becomes fast. In this case, the feeding motor 22 rotates for a while since the main microcomputer 102 outputted the stop instruction to the feeding motor 22 until the feeding motor 22 actually stops, so the final feed out amount of the wire W becomes large. On the other hand, in a case where the voltage of the battery B is low, as shown in FIG. 14B, the applied voltage to the feeding motor 22 becomes low and the rotation speed of the feeding motor 22 becomes slow. In this case, the feeding motor 22 hardly rotates since the main microcomputer 102 outputted the stop instruction to the feeding motor 22 until the feeding motor 22 actually stops, so the final feed out amount of the wire W becomes small. In the wire feeding process shown in FIG. 12, the feed amount threshold of the wire W is set to a small value when the open voltage of the battery B before the feeding motor 22 is driven is high, and the feed amount threshold of the wire W is set to a large value when the open voltage of the battery B before the feeding motor 22 is driven is low. With such a configuration, the variation in the feed amount of the wire W caused by the variation in the voltage of the battery B can be suppressed.

The main microcomputer 102 may set the duty ratio to a constant value (such as 100%) for driving the feeding motor 22 in step S66 of FIG. 12, regardless of the voltage of the battery B obtained in step S62. Even in this case, the variation in the feed amount of the wire W can be suppressed by setting the feed amount threshold of the wire W according to the open voltage of the battery B as aforementioned.

Figure 15:
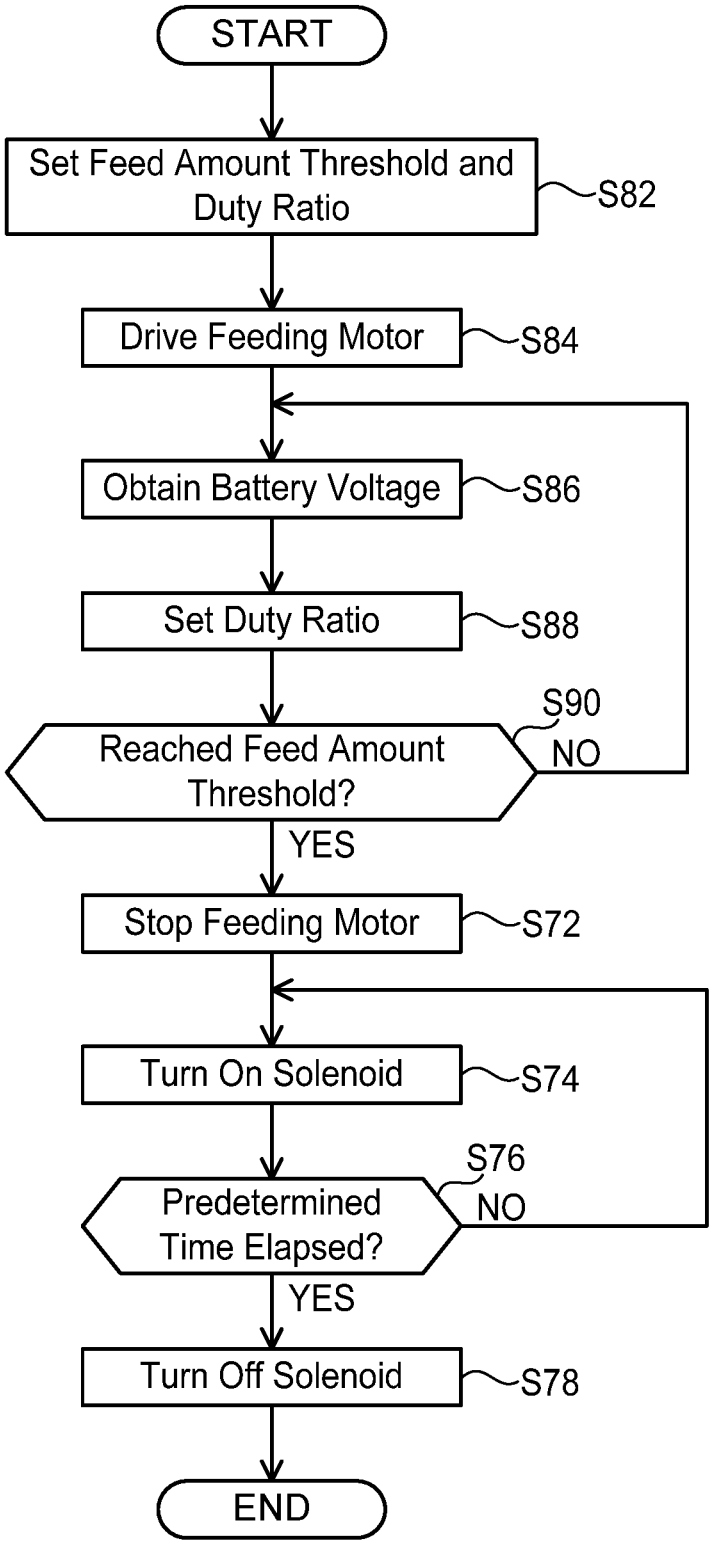
FIG. 15 is a flowchart explaining another example of the wire feeding process which the main microcomputer 102 executes in the rebar tying machine 2 according to the embodiment.

The main microcomputer 102 may execute a wire feeding process shown in FIG. 15 instead of the wire feeding process shown in FIG. 12. Hereinbelow, the wire feeding process shown in FIG. 15 will be described.

In step S82, the main microcomputer 102 sets the feed amount threshold based on the number of windings of the wire W set by the user, and sets the duty ratio to a predetermined value.

In step S84, the main microcomputer 102 drives the feeding motor 22 at the duty ratio set in step S82. Due to this, the feeding motor 22 rotates and the wire W is fed out.

In step S86, the main microcomputer 102 detects the voltage of the battery B by the voltage detection circuit 110.

In step S88, the main microcomputer 102 sets a duty ratio for driving the feeding motor 22 based on the voltage of the battery B obtained in step S86. Specifically, the main microcomputer 102 sets the duty ratio according to the voltage of the battery B obtained in step S86 so that the average applied voltage to the feeding motor 22 comes to be at a predetermined value.

In step S90, the main microcomputer 102 determines whether or not the feed amount of the wire W has reached the feed amount threshold set in step S82. In a case where the feed amount of the wire W has not reached the feed amount threshold (in a case of NO), the process returns to step S86. When the feed amount of the wire W reaches the feed amount threshold (YES in step S90), the process proceeds to step S72.

Processes of steps S72, S74, S76, S78 of FIG. 15 are similar to the processes of steps S72, S74, S76, S78 of FIG. 12.

Figure 16A:
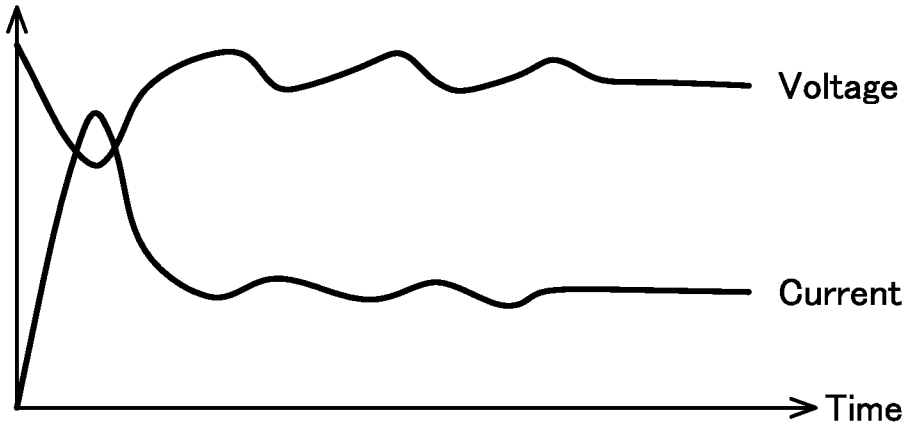
FIGS. 16A and 16B are graphs showing relationships of the voltage of the battery B, the current supplied from the battery B, and the rotation speed of the feeding motor 22 in the wire feeding process of FIG. 15.
Figure 16B:
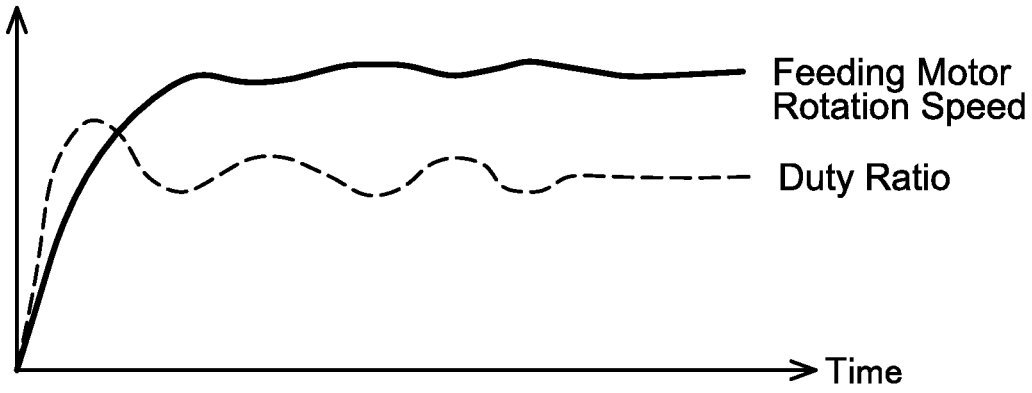

In the wire feeding process shown in FIG. 15, the duty ratio for the feeding motor 22 is continuously updated based on the voltage of the battery B during when the feeding motor 22 is being driven so that the average applied voltage to the feeding motor 22 remains constant. Due to this, even in the case where the voltage of the battery B varies as shown in FIG. 16A, the variation in the rotation speed of the feeding motor 22 can be suppressed as shown in FIG. 16B. In the wire feeding process shown in FIG. 15, the duty ratio for the feeding motor 22 is continuously updated based on the voltage of the battery B during when the feeding motor 22 is being driven, so the rotation speed of the feeding motor 22 can further be stabilized as compared to the case where the duty ratio for the feeding motor 22 is set based on the open voltage of the battery B before the feeding motor 22 is driven and the feeding motor 22 is continuously driven at the constant duty ratio as in the wire feeding process shown in FIG. 12. With such a configuration as well, the variation in the feed amount of the wire W accompanying the variation in the voltage of the battery B can be suppressed.

Figure 17:
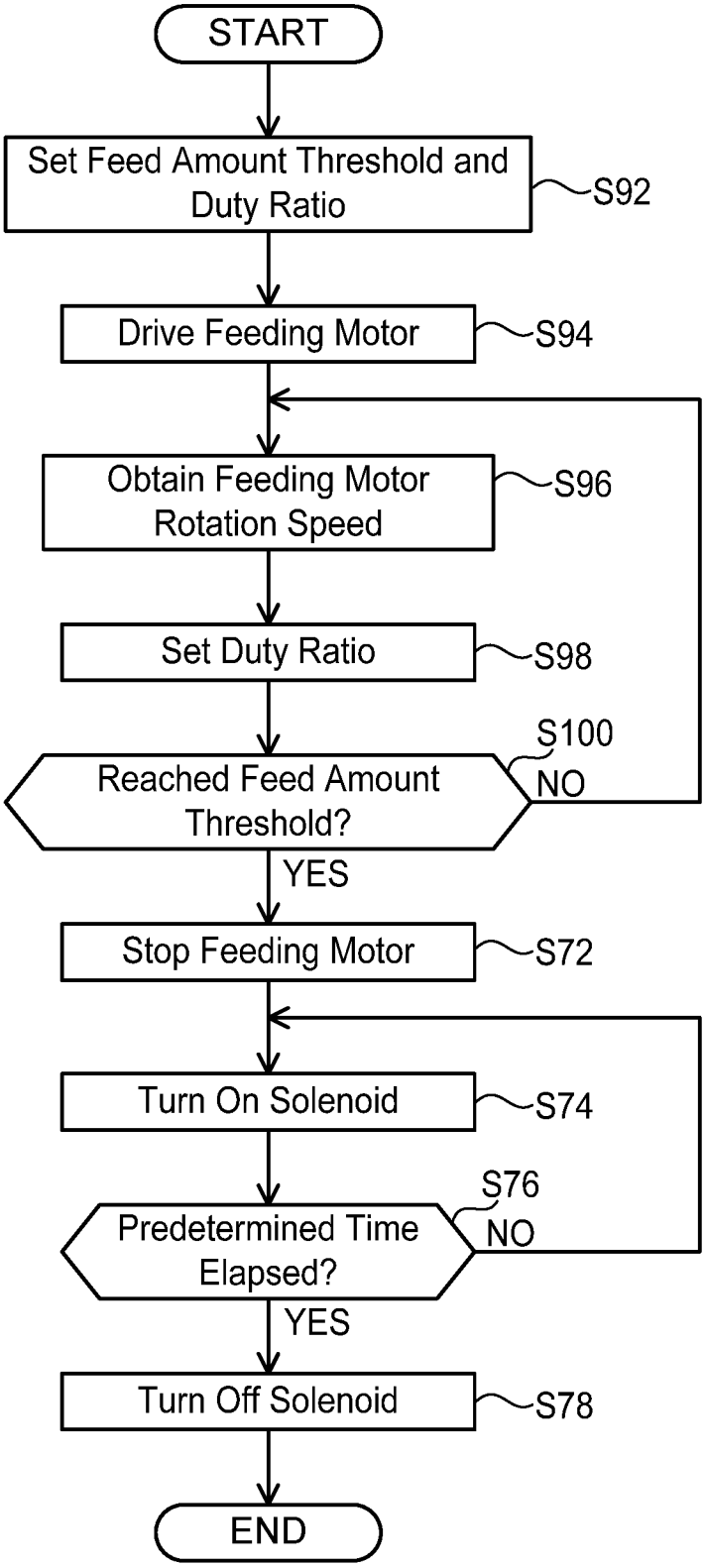
FIG. 17 is a flowchart explaining yet another example of the wire feeding process which the main microcomputer 102 executes in the rebar tying machine 2 according to the embodiment.

Alternatively, the main microcomputer 102 may execute a wire feeding process shown in FIG. 17 instead of the wire feeding processes shown in FIGS. 12 and 15. Hereinbelow, the wire feeding process shown in FIG. 17 will be described.

In step S92, the main microcomputer 102 sets the feed amount threshold based on the number of windings of the wire W set by the user, and sets a duty ratio to a predetermined value.

In step S94, the main microcomputer 102 drives the feeding motor 22 at the duty ratio set in step S92. Due to this, the feeding motor 22 rotates and the wire W is fed out.

In step S96, the main microcomputer 102 calculates the rotation speed of the feeding motor 22 by using the detection signal from the encoder 27.

In step S98, the main microcomputer 102 sets a duty ratio for the feeding motor 22 by PI control based on a difference between a targeted rotation speed of the feeding motor 22 and an actual rotation speed of the feeding motor 22 calculated in step S96.

In step S100, the main microcomputer 102 determines whether or not the feed amount of the wire W has reached the feed amount threshold set in step S92. In a case where the feed amount of the wire W has not reached the feed amount threshold (in a case of NO), the process returns to step S96. When the feed amount of the wire W reaches the feed amount threshold (YES in step S100), the process proceeds to step S72.

Processes of steps S72, S74, S76, S78 of FIG. 17 are similar to the processes of steps S72, S74, S76, S78 of FIG. 12.

Figure 18A:
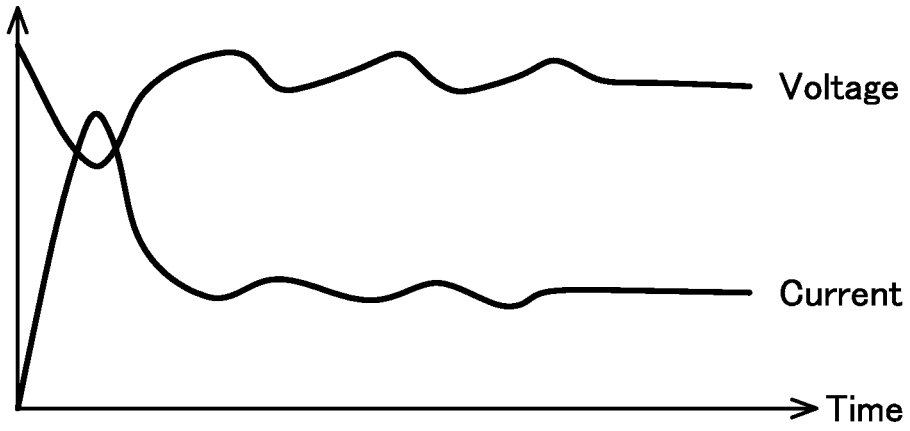
FIGS. 18A and 18B are graphs showing relationships of the voltage of the battery B, the current supplied from the battery B, and the rotation speed of the feeding motor 22 in the wire feeding process of FIG. 17.
Figure 18B:
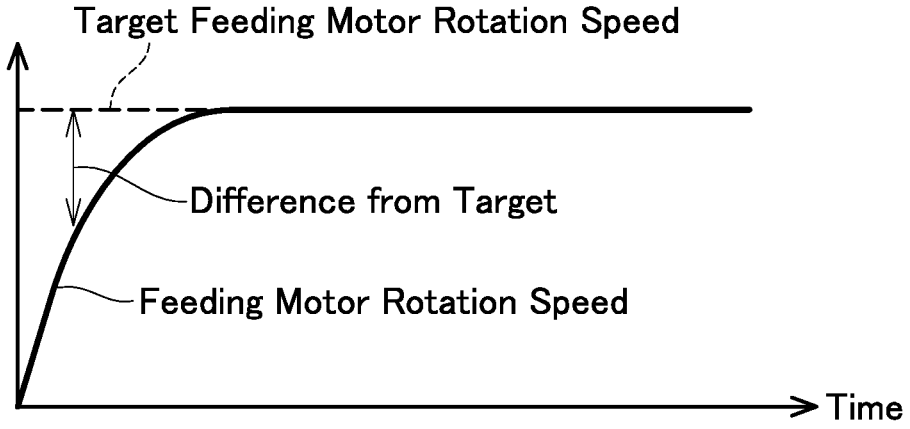

In the wire feeding process shown in FIG. 17, the duty ratio for the feeding motor 22 is continuously updated by the PI control so that the rotation speed of the feeding motor 22 remains constant during when the feeding motor 22 is being driven. Due to this, even in the case where the voltage of the battery B varies as shown in FIG. 18A, the rotation speed of the feeding motor 22 can be maintained constant as shown in FIG. 18B. In the wire feeding process shown in FIG. 17, the rotation speed of the feeding motor 22 can further be stabilized as compared to the wire feeding process shown in FIG. 12 and the wire feeding process shown in FIG. 15. With such a configuration as well, the variation in the feed amount of the wire W accompanying the variation in the voltage of the battery B can be suppressed.

In a case where the operation on the main switch 74 is performed (that is, the operation to turn off the main power of the rebar tying machine 2 is performed) while one of the wire feeding processes shown in FIGS. 12, 15, and 17 is being executed, the main microcomputer 102 does not immediately turn off the main power of the rebar tying machine 2 at that instant, but skips the processes preceding step S72 and executes the processes from steps S72 to S78, after which the main microcomputer 102 switches the protective FET 116 to off and switches the transistor 109 to off to turn off the main power of the rebar tying machine 2. With such a configuration, the wire W can be prevented from being loosened due to the reel 10 rotating by inertia after the power supply to the feeding motor 22 has been cut off.

Figure 19:
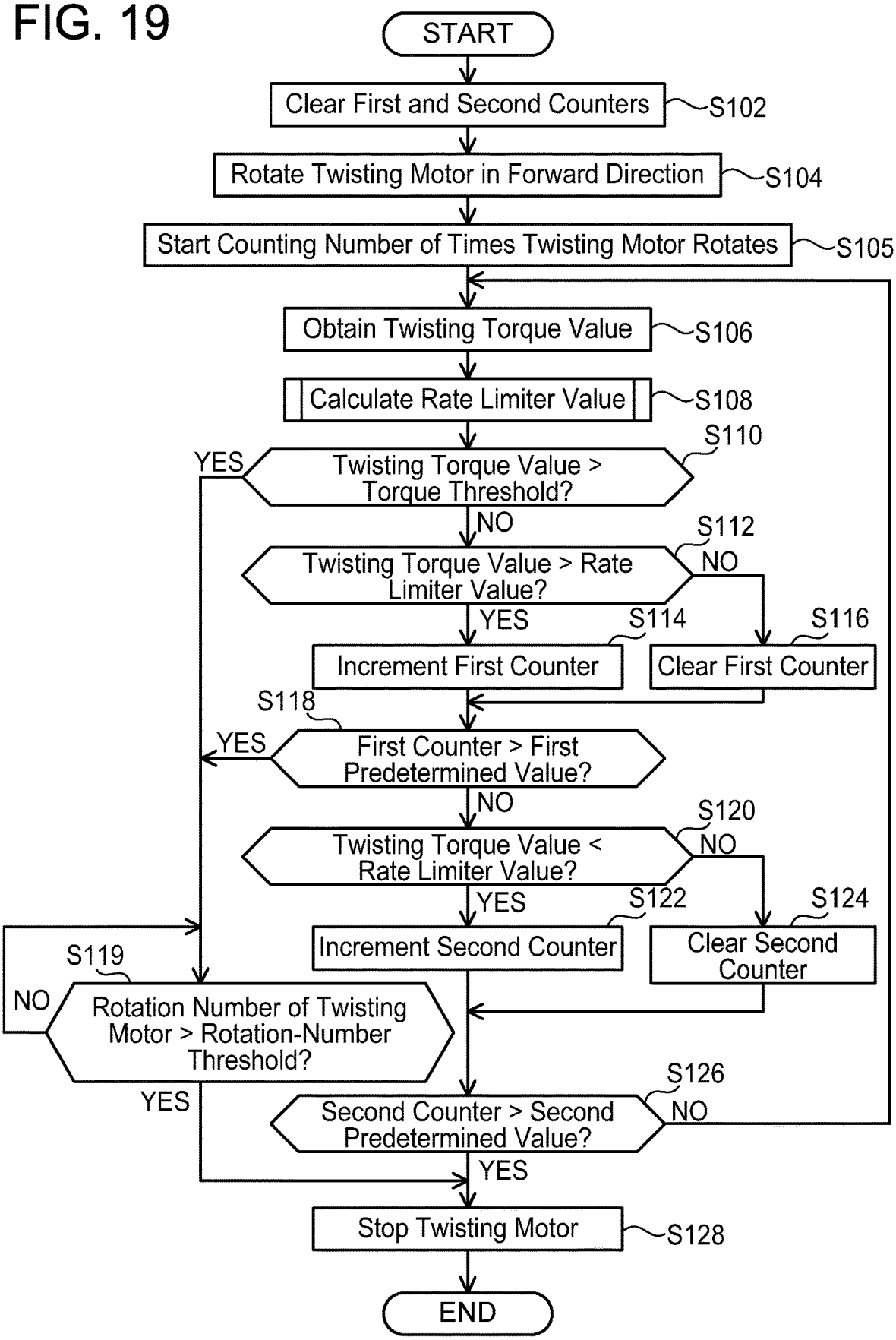
FIG. 19 is a flowchart explaining an example of a wire twisting process which the main microcomputer 102 executes in the rebar tying machine 2 according to the embodiment.

Hereinbelow, the wire twisting process in step S54 of FIG. 11 will be described. FIG. 19 shows processes which the main microcomputer 102 executes in the wire twisting process in step S54 of FIG. 11.

In step S102, the main microcomputer 102 clears both a first counter and a second counter.

In step S104, the main microcomputer 102 rotates the twisting motor 54 in the forward direction with 100% duty ratio.

In step S105, the main microcomputer 102 starts counting a number of times the twisting motor 54 rotates by using another counter that is different from the first and second counters. In the rebar tying machine 2 of the present embodiment, the main microcomputer 102 counts the number of times the twisting motor 54 rotates based on a detection signal of the Hall sensor 55.

In step S106, the main microcomputer 102 obtains load torque that acts on the twisting motor 54 as a twisting torque value. In the rebar tying machine 2 of the present embodiment, the main microcomputer 102 estimates the load torque that acts on the twisting motor 54 according to the following calculation, based on the voltage detected by the voltage detection circuit 110 and the current detected by the current detection circuit 112.

Figure 20:
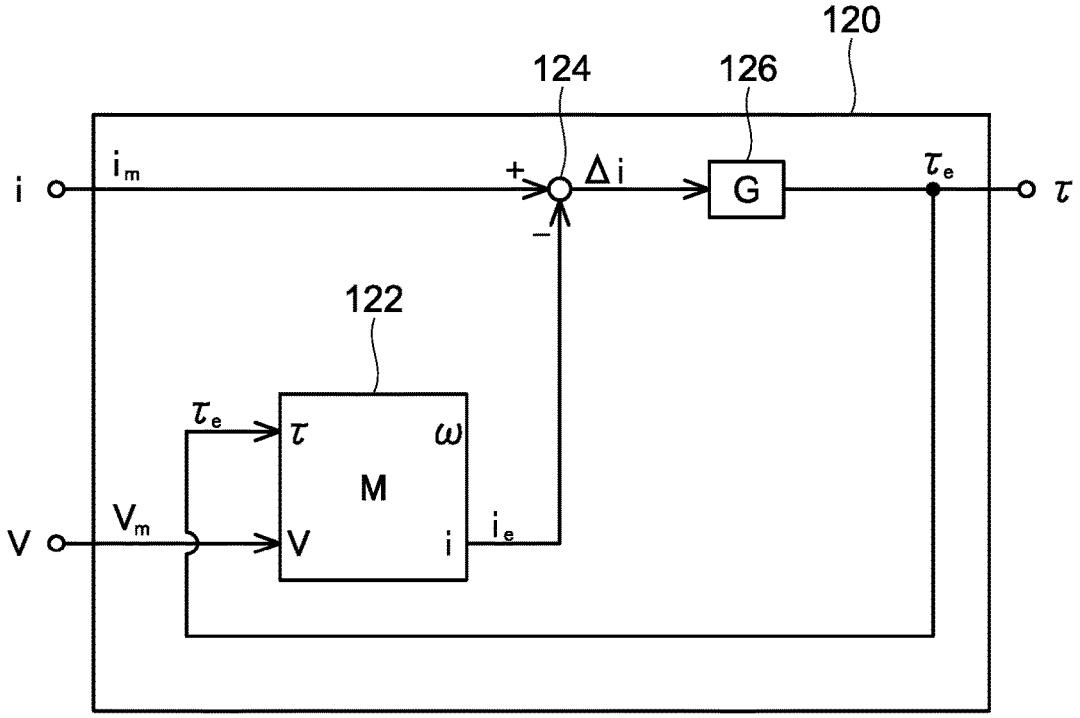
FIG. 20 is a block diagram showing an example of a feedback model 120 available for use in estimating load torque acting on a twisting motor 54 in the rebar tying machine 2 according to the embodiment.

FIG. 20 shows an example of a feedback model 120 that the main microcomputer 102 uses to estimate the load torque that acts on the twisting motor 54. The feedback model 120 outputs an estimated value $\tau_e$ of the load torque that acts on the twisting motor 54 based on a measured value $i_m$ of the current flowing in the twisting motor 54 and a measured value $V_m$ of an inter-terminal voltage of the twisting motor 54. At a time point when the main microcomputer 102 executes the process of step S106 of FIG. 19, the feeding motor 22 and the solenoid 46 are not driven. As such, the measured value $i_m$ of the current flowing in the twisting motor 54 can be detected by the current detection circuit 112. Further, the measured value $V_m$ of an inter-terminal voltage of the twisting motor 54 can be detected by the voltage detection circuit 110. The feedback model 120 is provided with a motor model 122, a comparator 124, and an amplifier 126.

The motor model 122 is a model of characteristics of the twisting motor 54 which is configured as a two-input and two-output transfer system. In the motor model 122, the inter-terminal voltage V of the twisting motor 54 and the load torque $\tau$ that acts on the twisting motor 54 are inputs, and the current i flowing in the twisting motor 54 and the rotation speed $\omega$ of the twisting motor 54 are outputs.

A characteristic of the motor model 122 can be specified based on an actual input-output characteristic of the twisting motor 54. For example, in the case where the twisting motor 54 is a DC brushless motor as in the present embodiment, the characteristic of the motor model 122 can be determined as below.

In regard to an electrical system of the twisting motor 54, a relational expression below is established, where L is an inductance, i is a current. V is an inter-terminal voltage, R is a resistance, KB is a power generation constant, and ω is a rotation speed:

$$L\frac{di}{dt} = V - Ri - KB\omega \tag{1}$$

On the other hand, in regard to a mechanical system of the twisting motor 54, a relational expression below is established, where J is moment of inertia of a rotor, KT is a torque constant, B is a frictional constant, and T is load torque:

$$J\frac{d\omega}{dt} = KTi - B\omega - \tau \tag{2}$$

In the disclosure herein, a left side of the above mathematical expression (2) is called inertial torque, a first term on a right side thereof is called output torque, a second term on the right side is called frictional torque, and a third term on the right side is called load torque.

When both sides of the above mathematical expressions (1) and (2) are integrated with respect to time, the following two relational expressions are obtained:

$$i = \int\left(\frac{1}{L}V - \frac{R}{L}i - \frac{KB}{L}\omega\right)dt \tag{3}$$

$$\omega = \int\left(\frac{KT}{J}i - \frac{B}{J}\omega - \frac{1}{J}\tau\right)dt \tag{4}$$

The two outputs i, ω for the two inputs V, τ can be calculated by performing numerical calculations based on the above mathematical expressions (3) and (4). As can be understood from the above, in the case where the motor model 122 is configured with the inter-terminal voltage V of the twisting motor 54 and the load torque τ that acts on the twisting motor 54 as the inputs and the current i flowing in the twisting motor 54 and the rotation speed w of the twisting motor 54 as the outputs, the respective outputs can be obtained by integration calculations without performing differential calculations. Generally, in a case where the main microcomputer 102 is implemented with a single chip microcomputer or the like, it is difficult to accurately perform the differential calculations in an event where the inter-terminal voltage V of the twisting motor 54 and the current i flowing in the twisting motor 54 abruptly change. However, by constructing the motor model 122 to obtain the outputs by the integration calculations as above, behaviors of the twisting motor 54 can be simulated with high accuracy even in the event where the inter-terminal voltage V of the twisting motor 54 and the current i flowing in the twisting motor 54 abruptly change.

As shown in FIG. 20, the current output of the motor model 122, that is, an estimated value $i_e$ of the current in the twisting motor 54 is supplied to the comparator 124. In the comparator 124, a difference Δi between the measured value $i_m$ of the current in the twisting motor 54 and the current output $i_e$ of the motor model 122 is calculated. The calculated difference Δi is amplified by a predetermined gain G in the amplifier 126, and is inputted to the torque input of the motor model 122 as the estimated load torque $\tau_e$ of the twisting motor 54. The measured value $V_m$ of the inter-terminal voltage of the twisting motor 54 is inputted to the voltage input of the motor model 122.

In the above feedback model 120, by setting the gain G in the amplifier 126 sufficiently large, a magnitude of the input torque of the motor model 122, that is, a magnitude of the estimated value $\tau_e$ of the load torque that acts on the twisting motor 54 is adjusted so that the current output of the motor model 122, that is, the estimated value $i_e$ of the current in the twisting motor 54 converges to the measured value $i_m$ of the current in the twisting motor 54. With such a configuration, the load torque $\tau_e$ that acts on the twisting motor 54, which would realize the current $i_m$ flowing in the twisting motor 54 when the inter-terminal voltage $V_m$ is applied to the twisting motor 54, and the rotation speed $w_e$ of the twisting motor 54 at such timing can be calculated by using the motor model 122.

Figure 21:
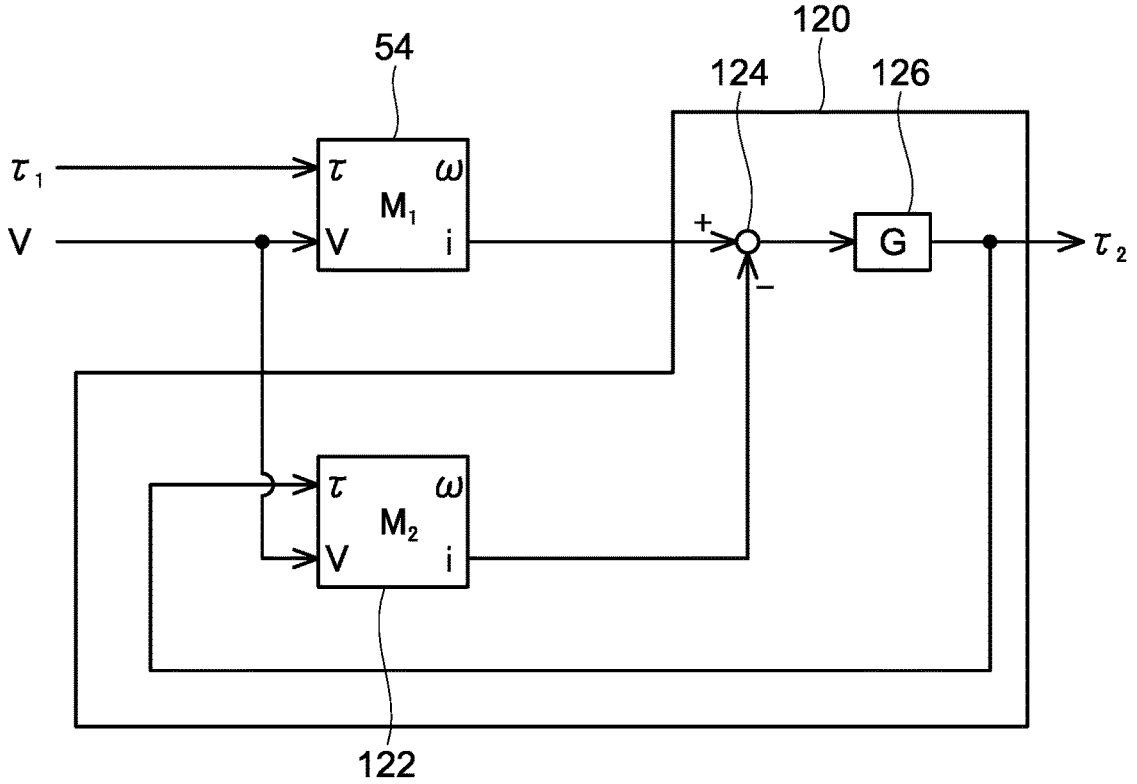
FIG. 21 is a block diagram explaining a principle based on which the load torque of the twisting motor 54 is estimated by the feedback model 120 in the rebar tying machine 2 according to the embodiment.

A principle based on which the load torque τ of the twisting motor 54 is estimated by the feedback model 120 will be described with reference to FIG. 21. In FIG. 21, the actual twisting motor 54 is expressed by a transfer function $M_1$, and the motor model 122 that is virtually implements the twisting motor 54 in the feedback model 120 is expressed by a transfer function $M_2$. A relationship between an input $\tau_1$ (a load torque value acting on the actual twisting motor 54) and an output $\tau_2$ (a torque estimated value outputted from the feedback model 120) in a control system shown in FIG. 21 is as follows:

$$\tau_2 = \frac{GM_1}{1 + GM_2}\tau_1 \tag{5}$$

As such, by setting the motor model 122 in the feedback model 120 to have equivalent characteristics to those of the actual twisting motor 54, replacement of $M_1=M_2=M$ can be performed in the above expression, by which a relational expression as below is obtained:

$$\tau_2 = \frac{GM}{1 + GM}\tau_1 \tag{6}$$

Figure 22:
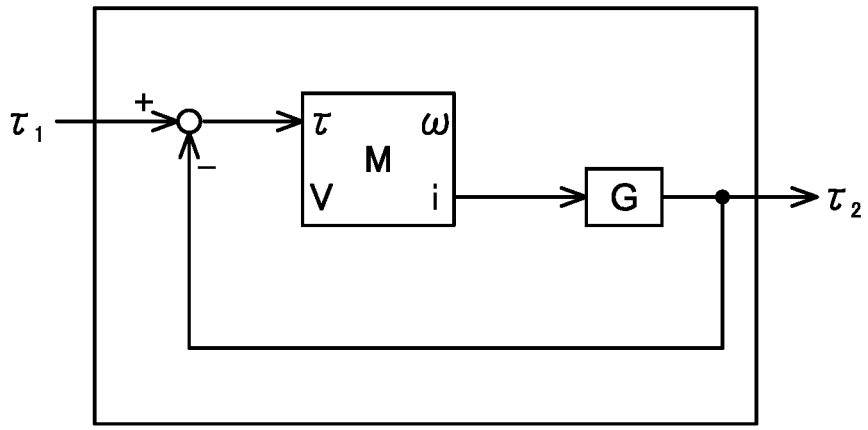
FIG. 22 is a block diagram showing a control system equivalent to a control system of FIG. 21.

As can be understood from the above mathematical expression (6), the transfer function from the input $\tau_i$ to the output $\tau_2$ in the control system of FIG. 21 is equivalent to a feedback control system as shown in FIG. 22 in which a forward transfer function is GM and a backward transfer function is 1. As such, the output $\tau_2$ changes to follow the input $\tau_1$. By setting the gain G in the amplifier 126 sufficiently large, the output $\tau_2$ converges to the input $\tau_1$. Thus, the load torque $\tau_1$ acting on the twisting motor 54 can be acknowledged from the torque estimated value $\tau_2$ outputted from the feedback model 120.

According to the feedback model 120 of the present embodiment, the load torque τ that acts on the twisting motor 54 can accurately be estimated based on the inter-terminal voltage V of the twisting motor 54 and the current i flowing in the twisting motor 54 without providing a dedicated sensor for torque detection.

In the present embodiment, the feedback model 120 including the motor model 122 that uses the inter-terminal voltage V of the twisting motor 54 and the load torque τ that acts on the twisting motor 54 as the inputs and the current i flowing in the twisting motor 54 and the rotation speed ω of the twisting motor 54 as the outputs is used to converge the current output $i_e$ of the motor model 122 to the current $i_m$ flowing in the actual twisting motor 54. With such a configuration, the load torque $\tau$ that acts on the twisting motor 54 can accurately be estimated without using the differential calculations.

Figure 23:
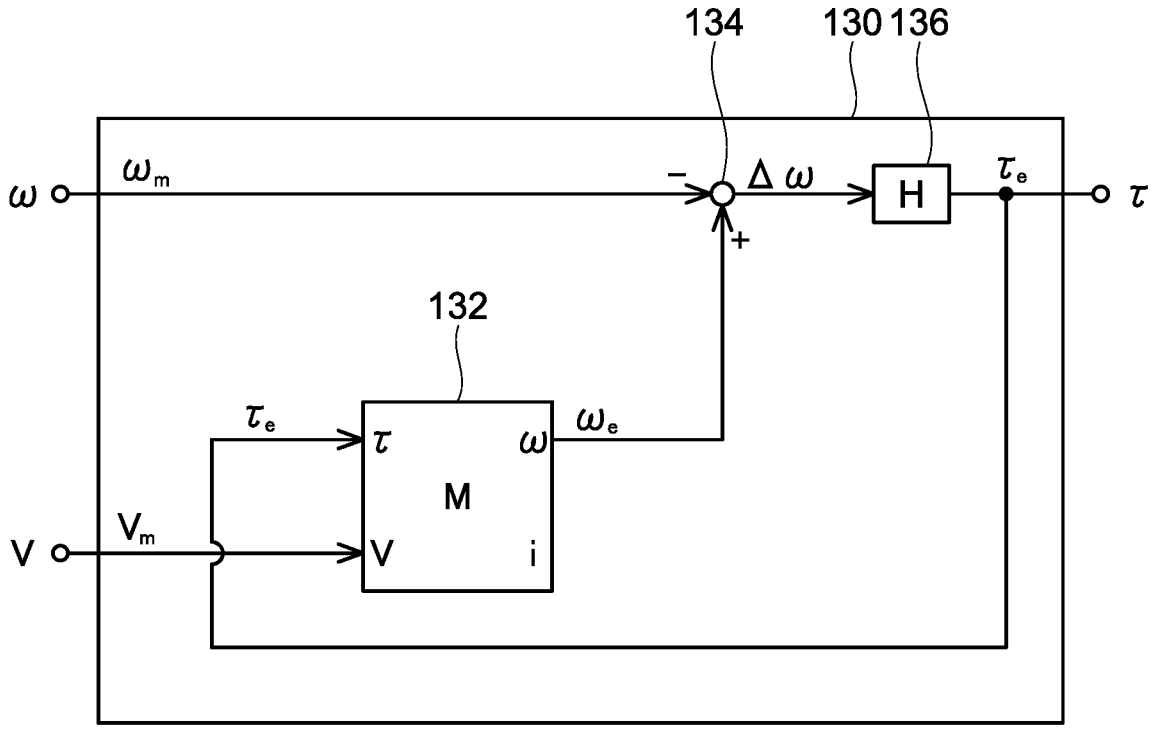
FIG. 23 is a block diagram showing an example of another feedback model 130 available for use in estimating the load torque acting on the twisting motor 54 in the rebar tying machine 2 according to the embodiment.

Alternatively, in a case where the twisting motor 54 is provided with a rotation speed sensor (not shown) configured to detect rotation speed, the load torque $\tau$ that acts on the twisting motor 54 may be estimated by using a feedback model 130 shown in FIG. 23. The feedback model 130 is configured to output the estimated value $\tau_e$ of the load torque that acts on the twisting motor 54 based on the measured value $\omega_m$ of the rotation speed of the twisting motor 54 detected by the rotation speed sensor and the measured value $V_m$ of the inter-terminal voltage of the twisting motor 54 detected by the voltage detection circuit 110. The feedback model 130 is provided with a motor model 132, a comparator 134, and an amplifier 136.

The motor model 132 of the feedback model 130 of FIG. 23 is same as the motor model 122 of the feedback model 120 of FIG. 20. In the feedback model 130 of FIG. 23, a rotation speed output of the motor model 132, that is, an estimated value $\omega_e$ of the rotation speed of the twisting motor 54, is supplied to the comparator 134. In the comparator 134, a difference $\Delta\omega$ between the rotation speed output $\omega_e$ of the motor model 132 and a measured value $\omega_m$ of the rotation speed of the twisting motor 54 is calculated. The calculated difference $\Delta\omega$ is amplified by a predetermined gain H in the amplifier 136, and is inputted to a torque input of the motor model 132 as the estimated load torque $\tau_e$ of the twisting motor 54. The measured value $V_m$ of the inter-terminal voltage of the twisting motor 54 is inputted to a voltage input of the motor model 132.

In the feedback model 130, by setting the gain H in the amplifier 136 sufficiently large, a magnitude of the input torque of the motor model 132, that is, a magnitude of the estimated value $\tau_e$ of the load torque that acts on the twisting motor 54 is adjusted so that the rotation speed output of the motor model 132, that is, the estimated value $\omega_e$ of the rotation speed of the twisting motor 54 converges to the measured value $\omega_m$ of the rotation speed of the twisting motor 54. With such a configuration, the load torque $\tau_e$ that acts on the twisting motor 54, which would realize the rotation speed $\omega_m$ of the twisting motor 54 when the inter-terminal voltage $V_m$ is applied to the twisting motor 54, can be estimated by using the motor model 132

Figure 24:
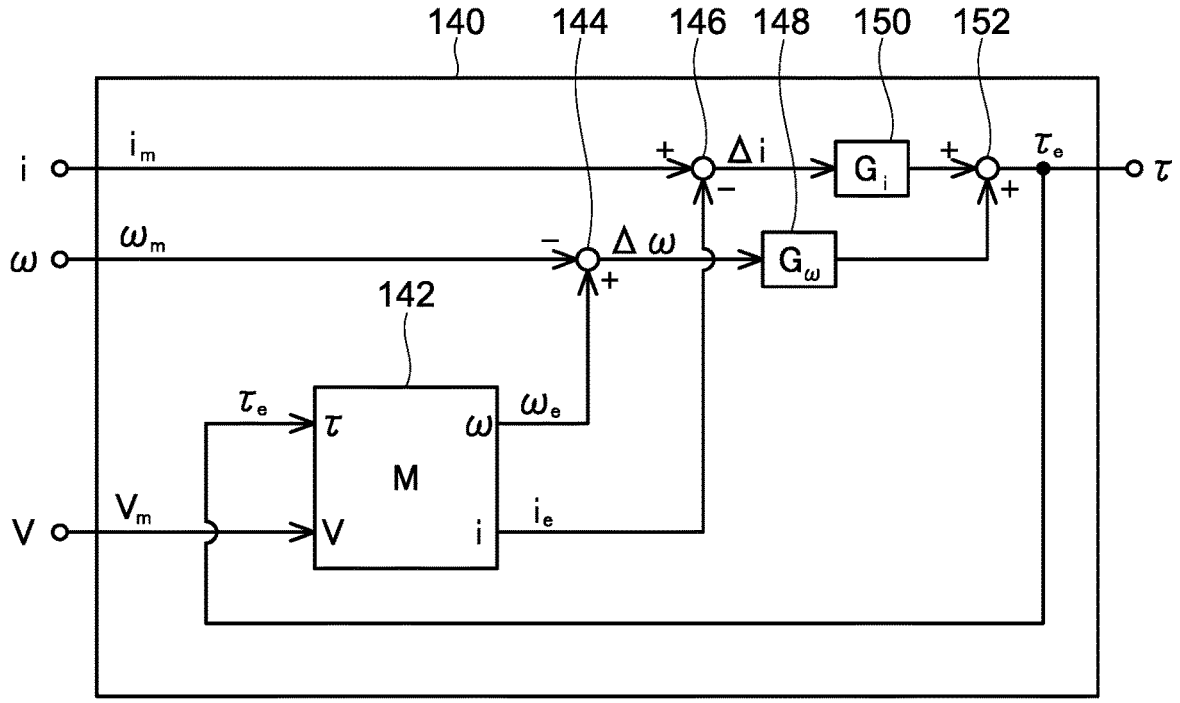
FIG. 24 is a block diagram showing an example of yet another feedback model 140 available for use in estimating the load torque acting on the twisting motor 54 in the rebar tying machine 2 according to the embodiment.

Alternatively, in a case where the twisting motor 54 is provided with a rotation speed sensor (not shown) configured to detect rotation speed, the load torque $\tau$ that acts on the twisting motor 54 may be estimated by using a feedback model 140 shown in FIG. 24. The feedback model 140 is configured to output the estimated value $\tau_e$ of the load torque that acts on the twisting motor 54 based on the measured value $i_m$ of the current flowing in the twisting motor 54 detected by the current detection circuit 112, the measured value $\omega_m$ of the rotation speed of the twisting motor 54 detected by the rotation speed sensor, and the measured value $V_m$ of the inter-terminal voltage of the twisting motor 54 detected by the voltage detection circuit 110. The feedback model 140 is provided with a motor model 142, comparators 144, 146, amplifiers 148, 150, and an adder 152.

The motor model 142 of the feedback model 140 of FIG. 24 is same as the motor model 122 of the feedback model 120 of FIG. 20. In the feedback model 140 of FIG. 24, a rotation speed output of the motor model 142, that is, an estimated value $w_e$ of the rotation speed of the twisting motor 54, is supplied to the comparator 144. In the comparator 144, a difference $\Delta\omega$ between the rotation speed output $\omega_e$ of the motor model 142 and the measured value $\omega_m$ of the rotation speed of the twisting motor 54 is calculated. The calculated difference $\Delta\omega$ is amplified by a predetermined gain $G_\omega$ in the amplifier 148, and is supplied to the adder 152. Further, in the feedback model 140, a current output of the motor model 142, that is, an estimated value $i_e$ of the current flowing in the twisting motor 54 is supplied to the comparator 146. In the comparator 146, a difference $\Delta i$ between the measured value $i_m$ of the current in the twisting motor 54 and the output value $i_e$ of the motor model 142 is calculated. The calculated difference $\Delta i$ is amplified by a predetermined gain $G_i$ in the amplifier 150, and is supplied to the adder 152. The adder 152 adds the output from the amplifier 148 and the output from the amplifier 150. An output of the adder 152 is inputted to a torque input of the motor model 142 as the estimated load torque $\tau_e$ of the twisting motor 54. The measured value $V_m$ of the inter-terminal voltage of the twisting motor 54 is inputted to a voltage input of the motor model 142.

In the feedback model 140, by setting the gain $G_\omega$ in the amplifier 148 and the gain $G_i$ in the amplifier 150 sufficiently large, a magnitude of the input torque of the motor model 142, that is, a magnitude of the estimated value $\tau_e$ of the load torque that acts on the twisting motor 54 is adjusted so that the rotation speed output of the motor model 142, that is, the estimated value $\omega_e$ of the rotation speed of the twisting motor 54 converges to the measured value $\omega_m$ of the rotation speed of the twisting motor 54, and the current output of the motor model 142, that is, the estimated value $i_e$ of the current in the twisting motor 54 converges to the measured value $i_m$ of the current in the twisting motor 54. With such a configuration, the load torque $\tau_e$ that acts on the twisting motor 54, which would realize the current $i_m$ flowing in the twisting motor 54 and the rotation speed $\omega_m$ of the twisting motor 54 when the inter-terminal voltage $V_m$ is applied to the twisting motor 54, can be estimated by using the motor model 142.

Figure 25:
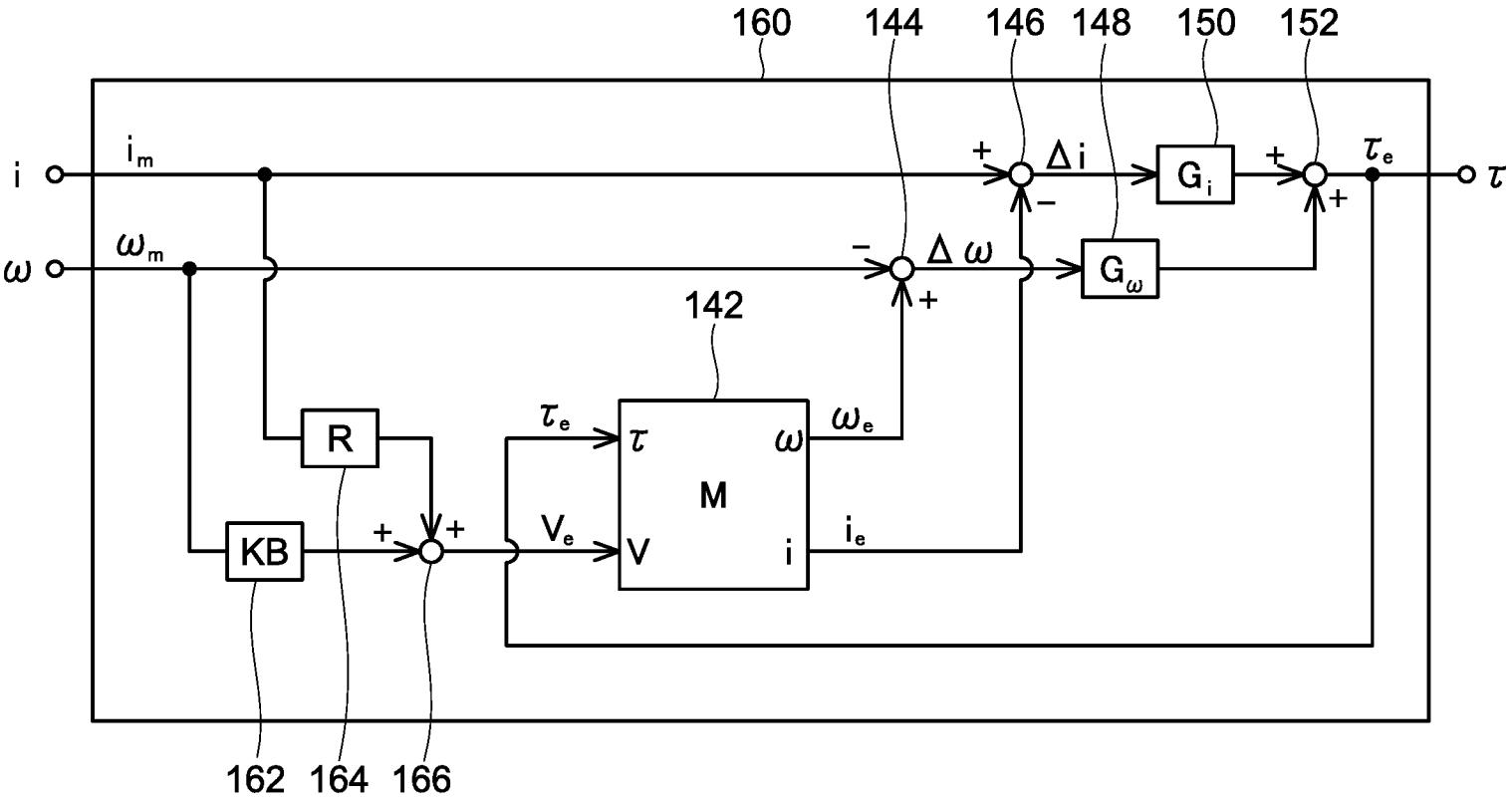
FIG. 25 is a block diagram showing an example of another feedback model 160 available for use in estimating the load torque acting on the twisting motor 54 in the rebar tying machine 2 according to the embodiment.

Alternatively, in a case where the twisting motor 54 is provided a rotation speed sensor (not shown) configured to detect rotation speed, the load torque $\tau$ that acts on the twisting motor 54 may be estimated by using a feedback model 160 shown in FIG. 25. The feedback model 160 is configured to output the estimated value $\tau_e$ of the load torque that acts on the twisting motor 54 based on the measured value $i_m$ of the current flowing in the twisting motor 54 detected by the current detection circuit 112 and the measured value $\omega_m$ of the rotation speed of the twisting motor 54 detected by the rotation speed sensor. The feedback model 160 is provided with the motor model 142, the comparators 144, 146, the amplifiers 148, 150, the adder 152, amplifiers 162, 164, and an adder 166.

The motor model 160 of FIG. 25 is provided with a substantially same configuration as that of the feedback model 140 of FIG. 24. In the feedback model 160 of FIG. 25, instead of the measured value $V_m$ of the inter-terminal voltage of the twisting motor 54, an estimated value $V_e$ of the inter-terminal voltage of the twisting motor 54 calculated from the measured value $i_m$ of the current flowing in the twisting motor 54 and the measured value $\omega_m$ of the rotation speed of the twisting motor 54 is inputted to the voltage input of the motor model 142. In the feedback model 160, the estimated value $V_e$ of the inter-terminal voltage of the twisting motor 54 is calculated by approximating Ldi/dt on the left side in the aforementioned mathematical expression (1) to zero. That is, in the feedback model 160, the estimated value $V_e$ of the inter-terminal voltage of the twisting motor 54 is calculated by adding a value obtained by multiplying the measured value $i_m$ of the current flowing in the twisting motor 54 by the resistance R of the twisting motor 54 to a value obtained by multiplying the measured value $\omega_m$ of the rotation speed of the twisting motor 54 by the power generation coefficient KB of the twisting motor 54.

Alternatively, the main microcomputer 102 may obtain the load torque that acts on the twisting motor 54 as the twisting torque value by using methods other than the ones described above.

When the twisting torque value is obtained in step S106 of FIG. 19, the process proceeds to step S108. In step S108, the main microcomputer 102 executes a calculation process for a rate limiter value.

Figure 26:
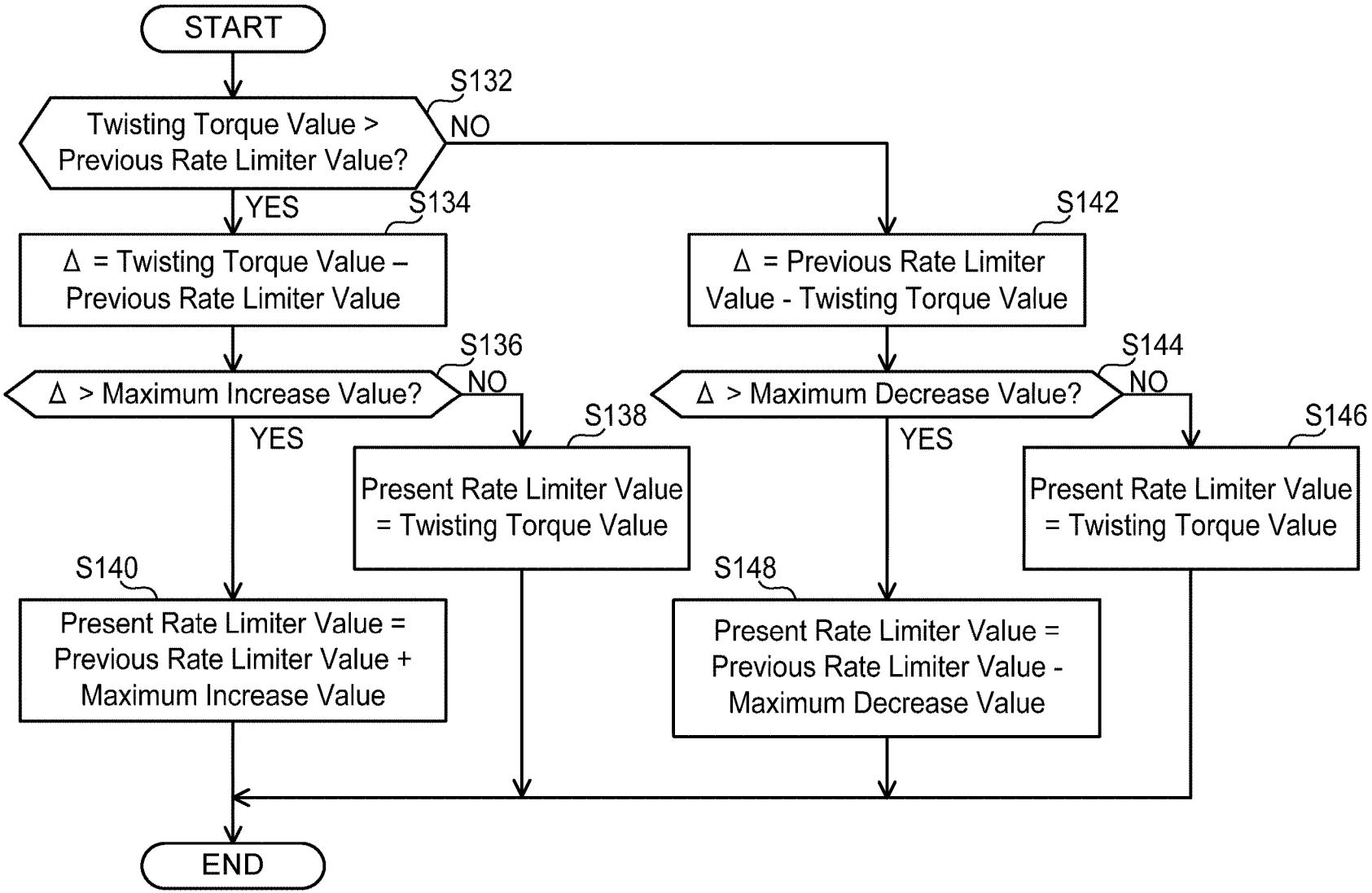
FIG. 26 is a flowchart explaining an example of a rate limiter value calculation process which the main microcomputer 102 executes in the rebar tying machine 2 according to the embodiment.

FIG. 26 shows processes which the main microcomputer 102 executes in the rate limiter value calculation process in step S108 of FIG. 19.

In step S132, the main microcomputer 102 determines whether or not the twisting torque value obtained in step S106 of FIG. 19 exceeds a previous rate limiter value. In a case where the twisting torque value exceeds the previous rate limiter value (in a case of YES), the process proceeds to step S134.

In step S134, the main microcomputer 102 calculates a value obtained by subtracting the previous rate limiter value from the twisting torque value as a difference Δ.

In step S136, the main microcomputer 102 determines whether or not the difference Δ calculated in step S134 exceeds a predetermined maximum increase value. In a case where the difference Δ does not exceed the maximum increase value (in a case of NO), the process proceeds to step S138. In step S138, the main microcomputer 102 sets the twisting torque value as a present rate limiter value. After step S138, the rate limiter calculation process of FIG. 26 is terminated.

In a case where the difference Δ exceeds the maximum increase value in step S136 (in a case of YES), the process proceeds to step S140. In step S140, the main microcomputer 102 sets a value obtained by adding the maximum increase value to the previous rate limiter value as the present rate limiter value. After step S140, the rate limiter calculation process of FIG. 26 is terminated.

In a case where the twisting torque value does not exceed the previous rate limiter value (in a case of NO) in step S132, the process proceeds to step S142.

In step S142, the main microcomputer 102 calculates a value obtained by subtracting the twisting torque value from the previous rate limiter value as the difference Δ

In step S144, the main microcomputer 102 determines whether or not the difference Δ calculated in step S142 exceeds a predetermined maximum decrease value. In a case where the difference Δ does not exceed the maximum decrease value (in a case of NO), the process proceeds to step S146. In step S146, the main microcomputer 102 sets the twisting torque value as the present rate limiter value. After step S146, the rate limiter calculation process of FIG. 26 is terminated.

In a case where the difference Δ exceeds the maximum decrease value in step S144 (in a case of YES), the process proceeds to step S148. In step S148, the main microcomputer 102 sets a value obtained by subtracting the maximum decrease value from the previous rate limiter value as the present rate limiter value. After step S148, the rate limiter calculation process of FIG. 26 is terminated.

Figure 27:
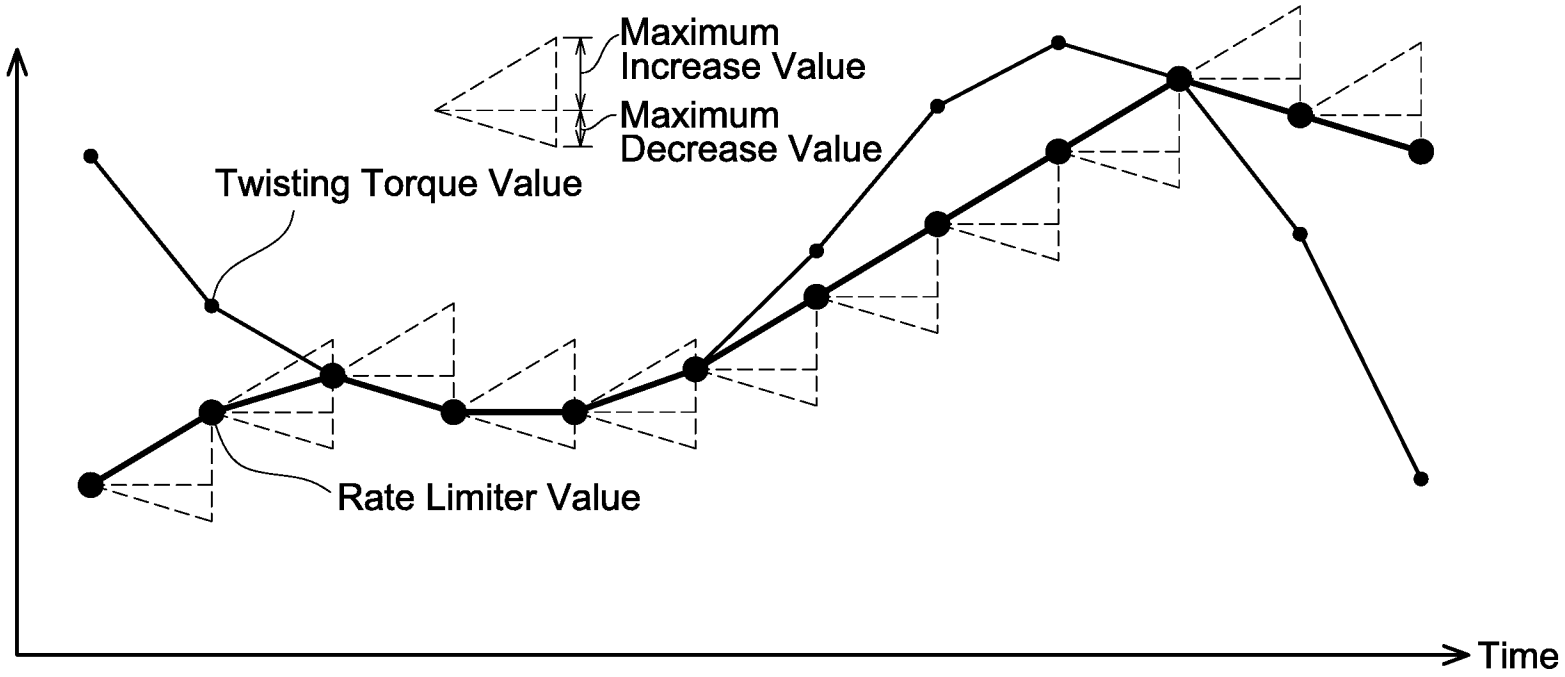
FIG. 27 is a graph showing a relationship between a chronological change in a twisting torque value and a chronological change in a rate limiter value in the rebar tying machine 2 according to the embodiment.

FIG. 27 shows chronological changes in the twisting torque value and chronological changes in the rate limiter value calculated corresponding thereto. As shown in FIG. 27, the rate limiter value moderately follows the twisting torque value in a range between the maximum increase value and the maximum decrease value. Due to this, if the change in the twisting torque value is moderate, the rate limiter value can follow the twisting torque value, by which they can become equal to each other. To the contrary, if the change in the twisting torque value is rapid, the rate limiter value cannot follow the twisting torque value, and a difference between them increases. In the present embodiment, the rate limiter value calculated as above is used as a condition for stopping the twisting motor 54.

When the rate limiter value is calculated in step S108 of FIG. 19, the process proceeds to step S110.

In step S110, the main microcomputer 102 determines whether or not the twisting torque value obtained in step S106 exceeds a torque threshold set by the user. In a case where the twisting torque value exceeds the torque threshold (in a case of YES), the process proceeds to step S119. In step S119, the main microcomputer 102 waits until the number of times the twisting motor 54 rotated since the twisting motor 54 started rotating exceeds a predetermined rotation number threshold. When the number of times the twisting motor 54 rotated exceeds the rotation number threshold in step S119 (YES in S119), the process proceeds to step S128. In step S128, the main microcomputer 102 stops the twisting motor 54. After step S128, the wire twisting process of FIG. 19 is terminated.

In a case where the twisting torque value does not exceed the torque threshold in step S110 (in a case of NO), the process proceeds to step S112. In step S112, the main microcomputer 102 determines whether or not the twisting torque value obtained in step S106 exceeds the rate limiter value calculated in step S108. In a case where the twisting torque value exceeds the rate limiter value (in a case of YES), the process proceeds to step S114. In step S114, the main microcomputer 102 increments the value of the first counter. After step S114, the process proceeds to step S118. In a case where the twisting torque value does not exceed the rate limiter value in step S112 (in a case of NO), the process proceeds to step S116. In step S116, the main microcomputer 102 clears the value of the first counter. After step S116, the process proceeds to step S118.

In step S118, the main microcomputer 102 determines whether or not the value of the first counter exceeds a first predetermined value. The value of the first counter increases in the case where the twisting torque value exceeds the rate limiter value, that is, in a case where the twisting torque value increases rapidly and the rate limiter value cannot follow the twisting torque value. As such, the value of the first counter exceeding the first predetermined value means that a first predetermined time has elapsed from a rise in the twisting torque value without the rate limiter value reaching the twisting torque value. In a case where the value of the first counter exceeds the first predetermined value in step S118 (in a case of YES), the main microcomputer 102 determines that the first predetermined time has elapsed since the rise in the twisting torque value was detected, and the process proceeds to step S119. In step S119, the main microcomputer 102 waits until the number of times the twisting motor 54 rotated since the twisting motor 54 started rotating exceeds the predetermined rotation number threshold. When the number of times the twisting motor 54 rotated exceeds the rotation number threshold in step S119 (YES in S119), the process proceeds to step S128. In step S128, the main microcomputer 102 stops the twisting motor 54. After step S128, the wire twisting process of FIG. 19 is terminated.

In a case where the value of the first counter does not exceed the first predetermined value in step S118 (in a case of NO), the process proceeds to step S120. In step S120, the main microcomputer 102 determines whether or not the twisting torque value obtained in step S106 is below the rate limiter value calculated in step S108. In a case where the twisting torque value is below the rate limiter value (in a case of YES), the process proceeds to step S122. In step S122, the main microcomputer 102 increments the value of the second counter. After step S122, the process proceeds to step S126. In a case where the twisting torque value is not below the rate limiter value in step S120 (in a case of NO), the process proceeds to step S124. In step S124; the main microcomputer 102 clears the value of the second counter. After step S124, the process proceeds to step S126.

In step S126, the main microcomputer 102 determines whether or not the value of the second counter exceeds a second predetermined value. The second predetermined value is set to a value smaller than the first predetermined value. The value of the second counter increases in the case where the twisting torque value is below the rate limiter value, that is, in a case where the twisting torque value decreases rapidly and the rate limiter value cannot follow the twisting torque value. As such, the value of the second counter exceeding the second predetermined value means that a second predetermined time has elapsed from a fall in the twisting torque value without the rate limiter value reaching the twisting torque value. In a case where the value of the second counter exceeds the second predetermined value in step S126 (in a case of YES), the main microcomputer 102 determines that the second predetermined time has elapsed since the fall in the twisting torque value was detected, and the process proceeds to step S128. In step S128, the main microcomputer 102 stops the twisting motor 54. After step S128, the wire twisting process of FIG. 19 is terminated. In a case where the value of the second counter does not exceed the second predetermined value in step S126 (in a case of NO), the process returns to step S106.

Figure 28:
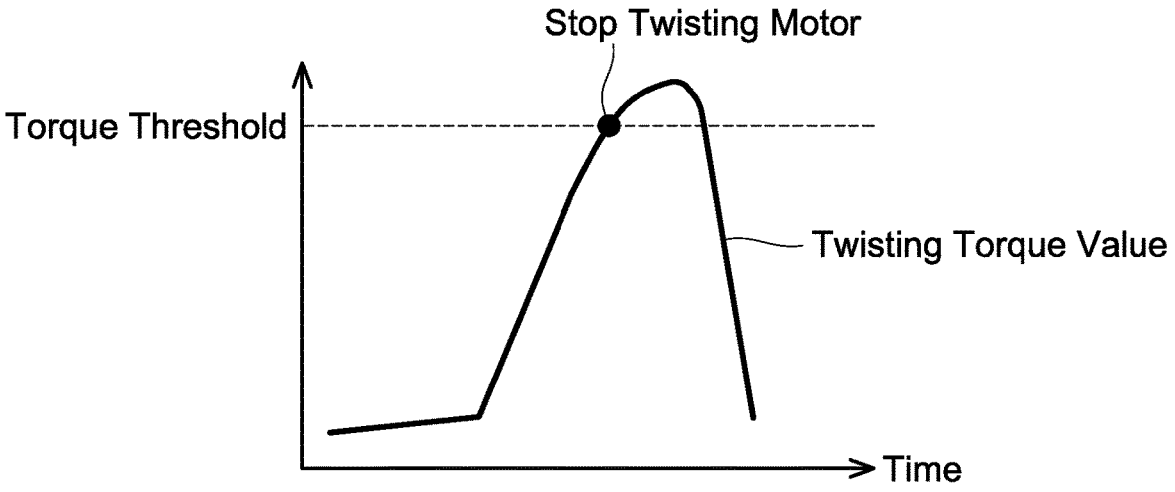
FIG. 28 is a graph explaining an example of a situation in which the twisting motor 54 is stopped in the rebar tying machine 2 according to the embodiment.

As shown in FIG. 28, the twisting torque value increases moderately until the wire W comes into tight contact around the rebars R, and it rapidly increases once the wire W is in tight contact around the rebars R. After this, when the wire W breaks due to the twisting motor 54 being kept rotating without stopping, the twisting torque value thereafter rapidly decreases.

In the wire twisting process of FIG. 19, as shown in FIG. 28, the twisting motor 54 is stopped at a time point when the twisting torque value reaches the torque threshold set by the user. With such a configuration, the rebars R can be tied with the wire W with a twisting strength which the user desires.

Generally, the twisting torque value with which the wire W breaks varies largely, and as shown in FIGS. 29 to 32, the wire W may break before the twisting torque value reaches the torque threshold. If the wire W that ties the rebars R together breaks, the rebars R may not be tied firmly with the wire W.

Figure 29:
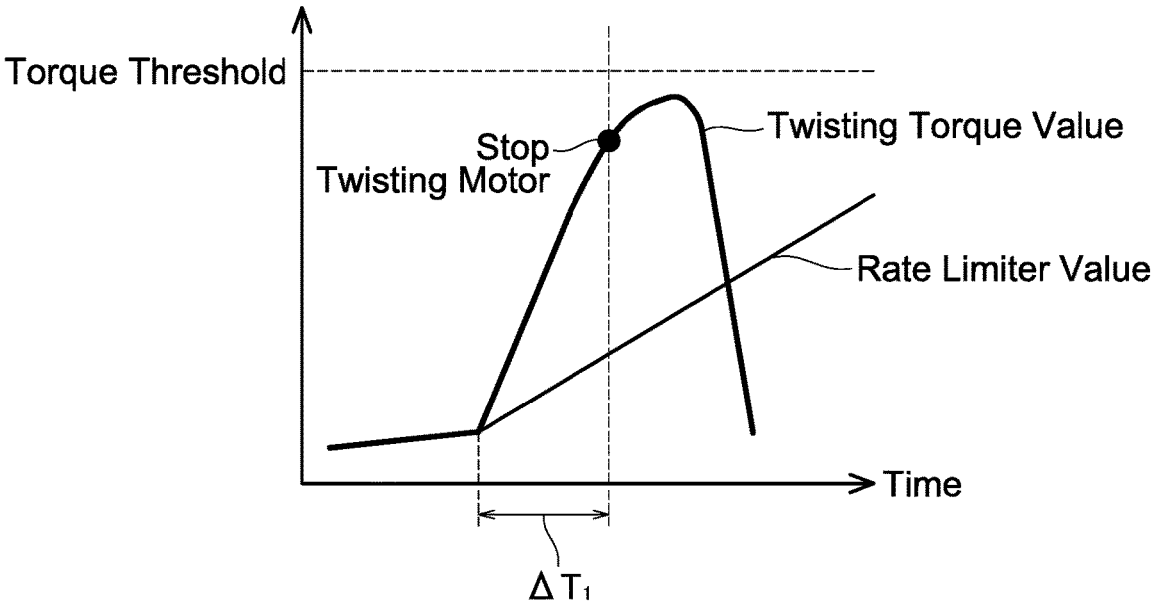
FIG. 29 is a graph explaining another example of the situation in which the twisting motor 54 is stopped in the rebar tying machine 2 according to the embodiment.

In the wire twisting process of FIG. 19, as shown in FIG. 29, the twisting motor 54 is stopped at a time point when the first predetermined time $\Delta T_1$ has elapsed from the rise in the twisting torque value, even before the twisting torque value reaches the torque threshold. As aforementioned, the twisting torque value starts to rapidly increase when the wire W comes into tight contact around the rebars R, and it is expected that the rebars R can be tied together firmly enough by the wire W by rotating the twisting motor 54 over the first predetermined time $\Delta T_1$ after the tight contact has been achieved. According to the wire twisting process of FIG. 19, the rebars R can be tied together firmly with the wire W while the wire W is suppressed from breaking.

Figure 30:
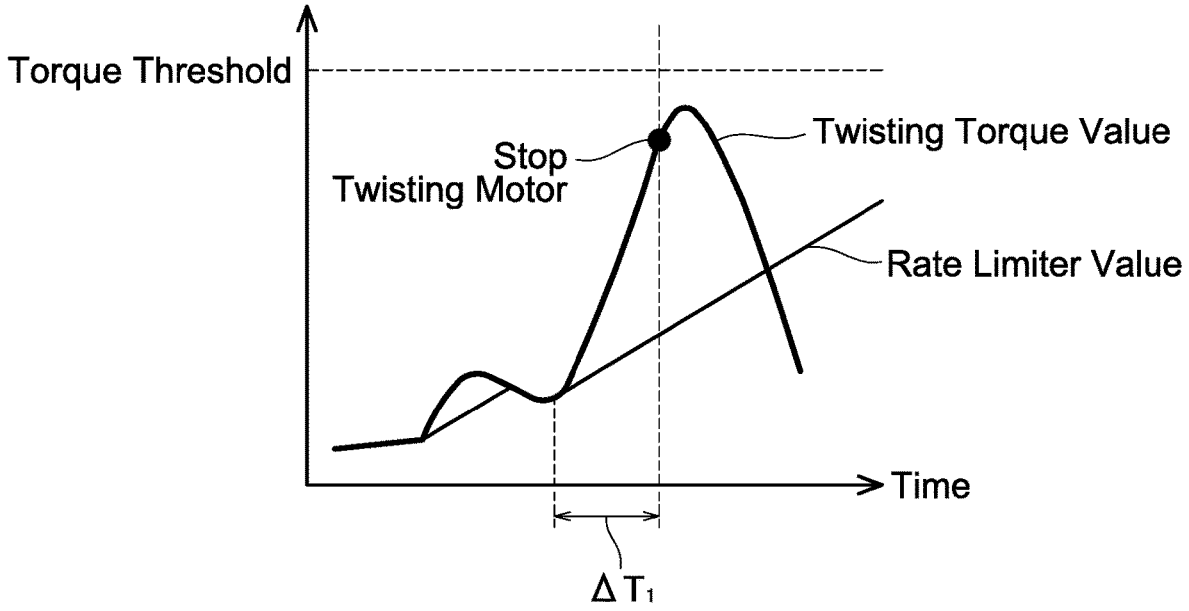
FIG. 30 is a graph explaining another example of the situation in which the twisting motor 54 is stopped in the rebar tying machine 2 according to the embodiment.
Figure 31:
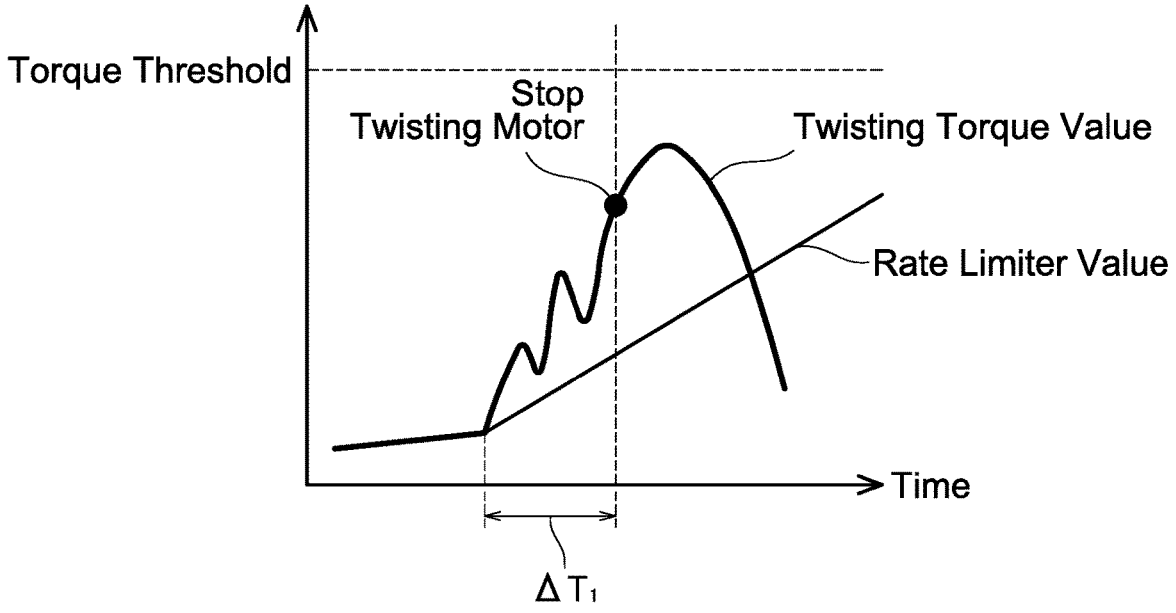
FIG. 31 is a graph explaining another example of the situation in which the twisting motor 54 is stopped in the rebar tying machine 2 according to the embodiment.

As shown in FIGS. 30 and 31, in the wire twisting process, there may be cases in which the twisting torque value increases and decreases due to the wire W being displaced on surfaces of the rebars R after the wire W came into tight contact around the rebars R and the twisting torque value started to rapidly increase. In the wire twisting process of FIG. 19, as shown in FIG. 30, in a case where the twisting torque value decreases significantly and the rate limiter value reaches the twisting torque value after the rise in the twisting torque value was detected, the first counter is cleared. Thereafter, the twisting motor 54 is stopped at a time point when the first predetermined time $\Delta T_1$ has elapsed since the rise in the twisting torque value was detected again. With such a configuration, the rebars R can be tied firmly with the wire W even in the case where the wire W is displaced on the surfaces of the rebars R at a degree that would affect the tying of the rebars R with the wire W. Further, in the wire twisting process of FIG. 19, as shown in FIG. 31, in a case where the twisting torque value continues to increase without the rate limiter value reaching the twisting torque value despite the twisting torque value slightly decreasing after the rise in the twisting torque value was detected, the twisting motor 54 is stopped at a time point when the first predetermined time $\Delta T_1$ has elapsed since the rise in the twisting torque value was initially detected. With such a configuration, breakage of the wire W can be suppressed and the rebars R can be tied firmly with the wire W even in a case where the wire W is displaced on the surfaces of the rebars R at a degree that would not affect the tying of the rebars R with the wire W.

Figure 32:
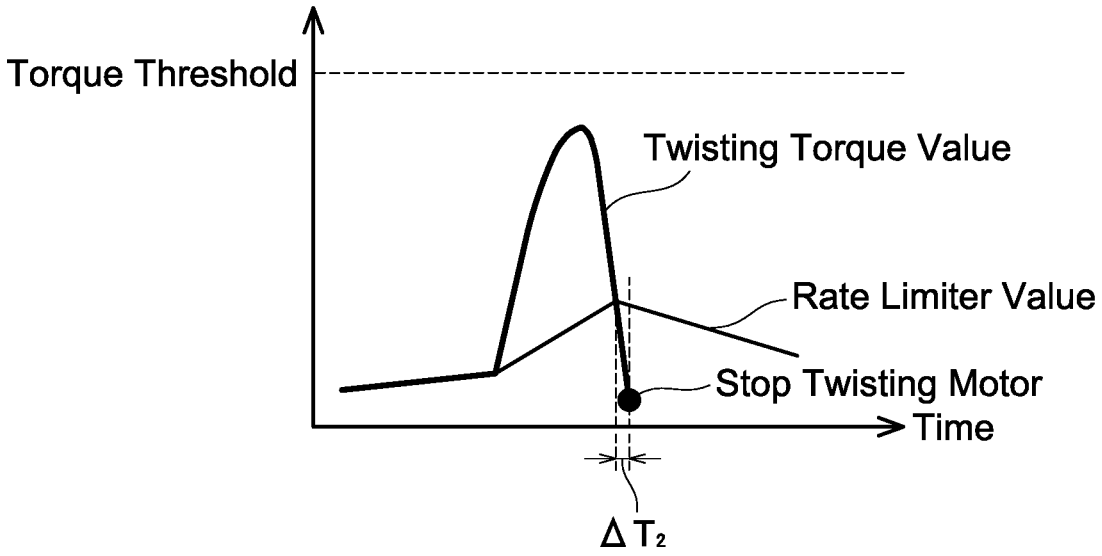
FIG. 32 is a graph explaining another example of the situation in which the twisting motor 54 is stopped in the rebar tying machine 2 according to the embodiment.

Even with the wire twisting process of FIG. 19, as shown in FIG. 32, there is a case where the wire W breaks before the twisting motor 54 is stopped. In such a case, it is preferable to stop the twisting motor 54 as soon as possible. In the wire twisting process of FIG. 19, as shown in FIG. 32, after a rise in the twisting torque value is detected, the detection of the rise in the twisting torque value is cancelled (the first counter is cleared) at a time point when the rate limiter value reaches the twisting torque value due to significant decrease in the twisting torque value caused by the breakage of the wire W. Thereafter, the twisting motor 54 is stopped at a time point when the second predetermined time $\Delta T_2$ has elapsed since a fall in the twisting torque value was detected. With such a configuration, the twisting motor 54 can be stopped promptly even when the wire W breaks before the twisting motor 54 is stopped.

The maximum increase value and the maximum decrease value of the rate limiter value used in the rate limiter value calculation process of FIG. 26 may be preset based on a torque curve of twisting torque value with a minimum rebar diameter. Further, the maximum increase value and the maximum decrease value of the rate limiter value, as well as the first predetermined value and the second predetermined value in the wire twisting process of FIG. 19 may be set by the user through the second operation unit 90.

Figure 33:
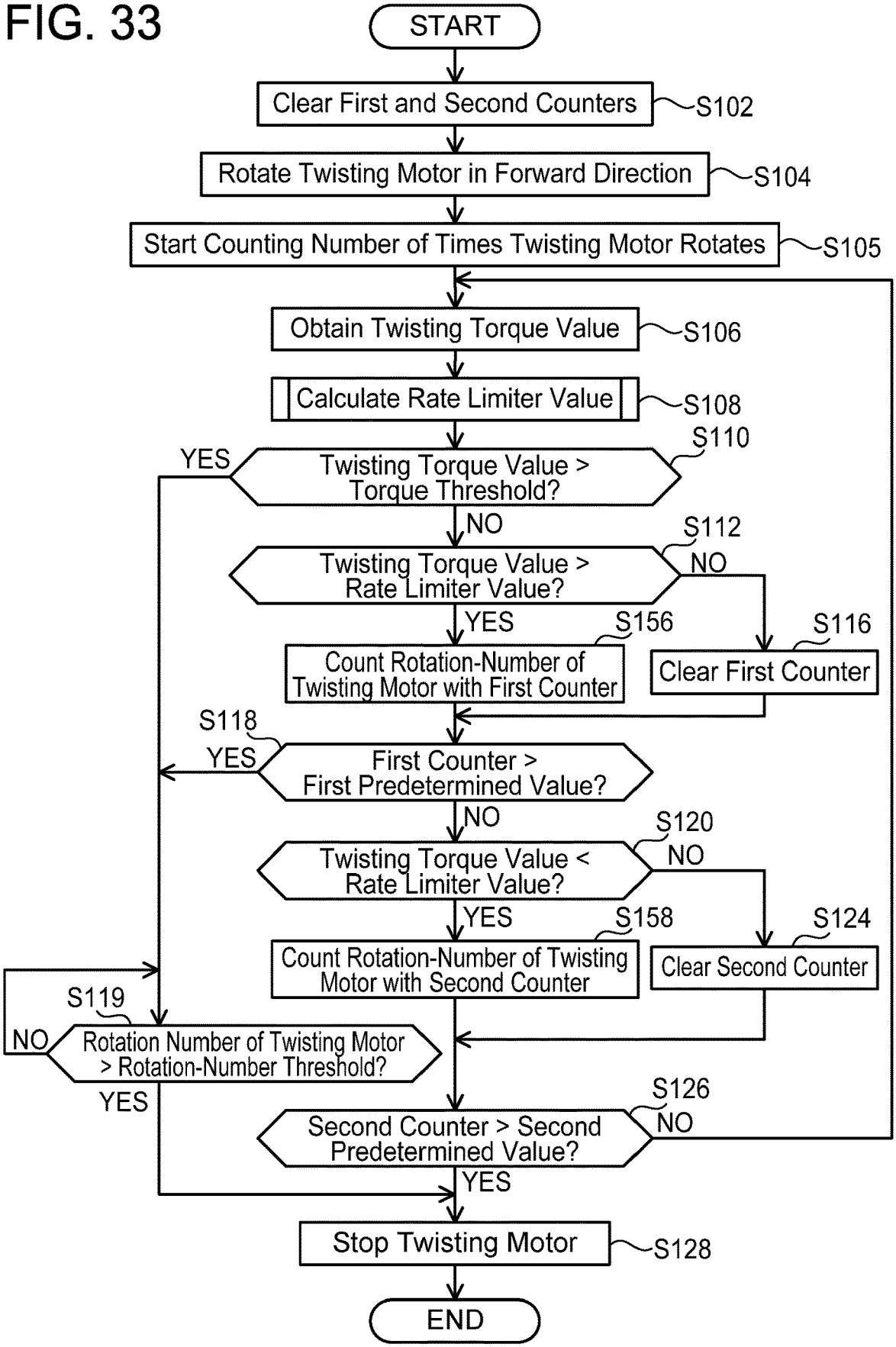
FIG. 33 is a flowchart explaining another example of the wire twisting process which the main microcomputer 102 executes in the rebar tying machine 2 according to the embodiment.

The main microcomputer 102 may execute a wire twisting process shown in FIG. 33 instead of the wire twisting process shown in FIG. 19.

Processes in steps S102, S104, S105, S106, S108, S110, S112, S116, and S118 of FIG. 33 are same as the processes of steps S102, S104, S105, S106, S108, S110, S112, S116, and S118 of FIG. 19. In the wire twisting process of FIG. 33, in the case where the twisting torque value exceeds the rate limiter value in step S112 (in a case of YES), the first counter is incremented in step S156 in cooperation with increase in the number of times the twisting motor 54 rotated. That is, in the wire twisting process of FIG. 33, the value of the first counter indicates the number of times the twisting motor 54 rotated since the time point when the twisting torque value exceeded the rate limiter value. In the case where the value of the first counter, that is, the number of times the twisting motor 54 rotated since the rise in the twisting torque value was detected, reaches the first predetermined value in step S118, the process proceeds to step S119. In step S119, the main microcomputer 102 waits until the number of times the twisting motor 54 rotated since the twisting motor 54 started rotating exceeds the predetermined rotation number threshold. When the number of times the twisting motor 54 rotated exceeds the rotation number threshold in step S119 (YES in S119), the process proceeds to step S128. In step S128, the main microcomputer 102 stops the twisting motor 54. After step S128, the wire twisting process of FIG. 33 is terminated.

Processes in steps S120, S124, and S126 of FIG. 33 are same as the processes in steps S120, S124, and S126 of FIG. 19. In the wire twisting process of FIG. 33, in the case where the twisting torque value is below the rate limiter value in step S120 (in case of YES), the second counter is incremented in step S158 in cooperation with the increase in the number of times the twisting motor 54 rotated. That is, in the wire twisting process of FIG. 33, the value of the second counter indicates the number of times the twisting motor 54 rotated since the time point when the twisting torque value became lower than the rate limiter value. In the case where the value of the second counter, that is, the number of times the twisting motor 54 rotated since the fall in the twisting torque value was detected, reaches the second predetermined value in step S126, the process proceeds to step S128. In step S128, the main microcomputer 102 stops the twisting motor 54. After step S128, the wire twisting process of FIG. 33 is terminated.

In the case where the operation on the main switch 74 is performed (that is, the operation to turn off the main power of the rebar tying machine 2 is performed) while the wire twisting process shown in FIG. 19 or 33 is being executed, the main microcomputer 102 stops the twisting motor 54 at that instant, after which it switches the protective FET 116 and the transistor 109 to off to turn off the main power of the rebar tying machine 2.

In one or more embodiments, the rebar tying machine 2 (an example of a tying machine) includes the twisting mechanism 20 configured to twist the wire W (an example of a tying string). The twisting mechanism 20 includes the twisting motor 54. The rebar tying machine 2 is configured to obtain the torque that acts on the twisting motor 54 as the twisting torque value (step S106 of FIG. 19, etc.), and is configured to stop the twisting motor 54 when a predetermined tying completion condition is satisfied (step S128 of FIG. 19, etc.). The predetermined tying completion condition includes that the elapsed time since the rise in the twisting torque value was detected reaches the first predetermined time (steps S112, S114, S118 of FIG. 19, etc.). According to the above configuration, an error determination that the twisting of the wire W is completed will not be made even when the twisting torque value increases and decreases, for example, due to the wire W being displaced on the surfaces of the rebars R while the twisting mechanism 20 is twisting the wire W.

In one or more embodiments, the rebar tying machine 2 includes the twisting mechanism 20 configured to twist the wire W. The twisting mechanism 20 includes the twisting motor 54. The rebar tying machine 2 is configured to obtain the torque that acts on the twisting motor 54 as the twisting torque value (step S106 of FIG. 33, etc.), and is configured to stop the twisting motor 54 when a predetermined tying completion condition is satisfied (step S128 of FIG. 33, etc.). The predetermined tying completion condition includes that the number of times the twisting motor 54 rotated since the rise in the twisting torque value was detected reaches the first predetermined number of times of rotations (steps S112, S156, S118 of FIG. 33, etc.). According to the above configuration, the error determination that the twisting of the wire W is completed will not be made even when the twisting torque value increases and decreases, for example, due to the wire W being displaced on the surfaces of the rebars R while the twisting mechanism 20 is twisting the wire W.

In one or more embodiments, the tying completion condition further includes that the twisting torque value reaches the predetermined torque threshold (step S110 of FIG. 19, step S110 of FIG. 33, etc.). According to the above configuration, the rebar tying machine 2 can be suppressed from receiving a large reaction force as a reaction to excessive twisting.

In one or more embodiments, the rebar tying machine 2 is configured not stop the twisting motor 54 even when the tying completion condition is satisfied, in the case where the number of times the twisting motor 54 rotated since the twisting motor 54 started rotating has not reached the predetermined rotation number threshold (step S119 of FIG. 19, step S119 of FIG. 33, etc.), and is configured to stop the twisting motor 54 in the case where the tying completion condition is satisfied and the number of times the twisting motor 54 rotated since the twisting motor 54 started rotating reaches the predetermined rotation number threshold (steps S119, S128 of FIG. 19, steps S119, S128 of FIG. 33, etc.). According to the above configuration, the number of twisting which is required at minimum for tying the rebars R can be applied to the wire W.

In one or more embodiments, the rebar tying machine 2 is configured to cancel detection of the rise in the twisting torque value when the predetermined cancellation condition is satisfied after the rise in the twisting torque value has been detected (steps S112, S116 of FIG. 19, steps S112, S116 of FIG. 33, etc.). When the wire W is displaced significantly on the surfaces of the rebars R while the twisting mechanism 20 is twisting the wire W, for example, it is preferable to redo the process to sufficiently twist the wire W. According to the above configuration, in such a case, the wire W can sufficiently be twisted again by the detection of the rise in the twisting torque value being cancelled.

In one or more embodiments, the detection of the rise in the twisting torque value includes detection of change from the state in which the twisting torque value is equal to the rate limiter value calculated based on the twisting torque value to the state in which the twisting torque value is higher than the rate limiter value (step S112 of FIG. 19, step S112 of FIG. 33, etc.). The twisting torque value increases moderately until the wire W comes into tight contact around the rebars R, and once the wire W is in tight contact around the rebars R, it rapidly increases. In order to detect the rise in the twisting torque value which changes as above, the rate limiter value is used in the above configuration. The rate limiter value moderately follows the twisting torque value in the range between the maximum increase value and the maximum decrease value. Due to this, the rate limiter value can follow the twisting torque value when the change in the twisting torque value is moderate, by which they become equal. To the contrary, when the change in the twisting torque value is rapid, the rate limiter value cannot follow the twisting torque value, and the difference between them increases. According to the above configuration, the rise in the twisting torque value can accurately be detected by using the rate limiter value.

In one or more embodiments, the cancellation condition includes that the rate limiter value becomes equal to the twisting torque value again after having deviated therefrom (step S112 of FIG. 19, step S112 of FIG. 33, etc.). In the case where the twisting toque value keeps increasing after the rise in the twisting torque value is detected by the state change from the state in which the rate limiter value is equal to the twisting torque value to the state in which the twisting torque value is higher than the rate limiter value, without the rate limiter value becoming equal to the twisting torque value again, it is expected as that the wire W is not displaced significantly on the surfaces of the rebars R and the tying operation for the rebars R is progressing under good condition. To the contrary, in the case where the rate limiter value becomes equal to the twisting torque value again after the rise in the twisting torque value is detected by the state change from the state in which the rate limiter value is equal to the twisting torque value to the state in which the twisting torque value is higher than the rate limiter value, that is, in the case where the twisting torque value decreases relatively significantly, it is expected that the wire W is displaced significantly on the surfaces of the rebars R, and the wire W needs to be twisted sufficiently again. According to the above configuration, even in the case where the wire W is displaced significantly on the surfaces of the rebars R while the twisting mechanism 20 is twisting the wire W, the wire W can be sufficiently twisted again.

In one or more embodiments, in the case where the rise in the twisting torque value is not detected and the fall in the twisting torque value is detected, the rebar tying machine 2 is configured to stop the twisting motor when the elapsed time since the fall in the twisting torque value was detected reaches the second predetermined time (steps S120, S122, S126, S128 of FIG. 19, etc.). According to the above configuration, the twisting motor 54 can be stopped promptly in the case where the wire W breaks before the twisting motor 54 is stopped.

In one or more embodiments, in the case where a rise in the twisting torque value is not detected and the fall in the twisting torque value is detected, the rebar tying machine 2 is configured to stop the twisting motor 54 when the number of times the twisting motor 54 rotated since the fall in the twisting torque value was detected reaches the second predetermined number of times of rotations (steps S120, S158, S126, S128 of FIG. 33, etc.). According to the above configuration, the twisting motor 54 can be stopped promptly in the case where the wire W breaks before the twisting motor 54 is stopped.

In one or more embodiments, the detection of the fall in the twisting torque value may include detection of the change from the state in which the twisting torque value is equal to the rate limiter value calculated based on the twisting torque value to the state in which the twisting torque value is lower than the rate limiter value (step S120 of FIG. 19, step S120 of FIG. 33, etc.). The twisting torque value rapidly increases after the wire W is in tight contact around the rebars R, however, when the wire W breaks, it rapidly decreases thereafter. To detect the fall in the twisting torque value which changes as above, the rate limiter value is used in the above configuration. The rate limiter value moderately follows the twisting torque value in the range between the maximum increase value and the maximum decrease value. Due to this, the rate limiter value can follow the twisting torque value when the change in the twisting torque value is moderate, by which they become equal. To the contrary, when the change in the twisting torque value is rapid, the rate limiter value cannot follow the twisting torque value, and the difference between them increases. According to the above configuration, the fall in the twisting torque value can accurately be detected by using the rate limiter value.

In one or more embodiments, the rebar tying machine 2 (an example of a tying machine) includes the feeding mechanism 12 configured to feed out the wire W (an example of a tying string), the battery B, and the voltage detection circuit 110 configured to detect the voltage of the battery B. The feeding mechanism 12 includes the feeding motor 22 to which power is supplied from the battery B. The rebar tying machine 2 is configured to set the duty ratio for driving the feeding motor 22 when feeding the wire W in accordance with the voltage of the battery B detected by the voltage detection circuit 110 (steps S62, S66 of FIG. 12, steps S86, S88 of FIG. 15, etc.). In the configuration in which the feeding motor 22 is supplied with the power from the battery B, the rotation speed of the feeding motor 22 changes according to the voltage of the battery B. If there are variations in the rotation speed of the feeding motor 22 at the time point when the main microcomputer 102 instructs the feeding motor 22 to stop, the overshoot amount of the wire W caused until the feeding motor 22 actually stops would vary, by which the total amount of the wire W that is fed out varies as well. According to the above configuration, since the duty ratio for driving the feeding motor 22 is set according to the voltage of the battery B, the variation in the rotation speed of the feeding motor 22 caused by the variation in the voltage of the battery B can be suppressed. With such a configuration, the amount of the wire W fed out from the feeding mechanism 12 can be suppressed from varying.

In one or more embodiments, the rebar tying machine 2 is configured to set the duty ratio for driving the feeding motor 22 in accordance with the voltage of the battery B detected by the voltage detection circuit 110 before feeding the wire W (steps S62, S66 of FIG. 12, etc.). The rebar tying machine 2 is configured to maintain the duty ratio for driving the feeding motor 22 constant while feeding the wire W (step S68 of FIG. 12). According to the above configuration, since the duty ratio set according to the actual voltage of the battery B is maintained constant while the wire W is being fed out, the variation in the rotation speed of the feeding motor 22 caused by the variation in the voltage of the battery B can be suppressed. The amount of the wire W fed out from the feeding mechanism 12 can be suppressed from varying.

In one or more embodiments, the rebar tying machine 2 is configured to adjust the duty ratio for driving the feeding motor 22 in accordance with the voltage of the battery B detected by the voltage detection circuit 110 so as to maintain the average applied voltage on the feeding motor 22 constant while feeding the wire W (steps S84, S86, S88 of FIG. 15, etc.). According to the above configuration, since the average applied voltage on the feeding motor 22 is maintained constant while the wire W is fed out, the variation in the rotation speed of the feeding motor 22 caused by the variation in the voltage of the battery B can be suppressed. The amount of the wire W fed out from the feeding mechanism 12 can be suppressed from varying.

In one or more embodiments, the rebar tying machine 2 includes the feeding mechanism 12 configured to feed the wire W, and the battery B. The feeding mechanism 12 includes the feeding motor 22 to which power is supplied from the battery B, and the encoder 27 (an example of a rotation speed sensor) configured to detect the rotation speed of the feeding motor 22. The rebar tying machine 2 is configured to adjust the duty ratio for driving the feeding motor 22 in accordance with the rotation speed of the feeding motor 22 detected by the encoder 27 so as to maintain the rotation speed of the feeding motor 22 constant while feeding the wire W (steps S94, S96, S98 of FIG. 17, etc.). According to the above configuration, the rotation speed of the feeding motor 22 is maintained constant while the wire W is fed out, so the variation in the rotation speed of the feeding motor 22 caused by the variation in the voltage of the battery B can be suppressed. The amount of the wire W fed out from the feeding mechanism 12 can be suppressed from varying.

In the above embodiment, the rebar tying machine 2 configured to tie the plural rebars R with the wire W was described, however, the tying string may not be the wire W, and an object to be tied may not be the plurality of rebars R.

What is claimed is:

1. A tying machine comprises:

a feeding mechanism configured to feed a tying string;

a twisting mechanism configured to twist the tying string fed from the feeding mechanism around an object to be tied;

a battery;

a voltage detection circuit configured to detect a voltage of the battery; and a computer, wherein the feeding mechanism includes a feeding motor to which power is supplied from the battery, and the computer is configured to set a duty ratio for driving the feeding motor when feeding the tying string, in accordance with the voltage of the battery detected by the voltage detection circuit.

2. The tying machine according to claim 1, wherein the computer is configured to:

set the duty ratio for driving the feeding motor in accordance with the voltage of the battery detected by the voltage detection circuit before feeding the tying string; and maintain the duty ratio for driving the feeding motor constant while feeding the tying string.

3. The tying machine according to claim 1, wherein the computer is configured to adjust the duty ratio for driving the feeding motor in accordance with the voltage of the battery detected by the voltage detection circuit so as to maintain an average applied voltage on the feeding motor constant while feeding the tying string.

4. A tying machine comprises:

a feeding mechanism configured to feed a tying string;

a twisting mechanism configured to twist the tying string fed from the feeding mechanism around an object to be tied;

a battery; and a computer, wherein the feeding mechanism includes:

a feeding motor to which power is supplied from the battery; and a rotation speed sensor configured to detect a rotation speed of the feeding motor, and the computer is configured to adjust a duty ratio for driving the feeding motor in accordance with the rotation speed of the feeding motor detected by the rotation speed sensor so as to maintain the rotation speed of the feeding motor constant while feeding the tying string.

* * * * *